US006630277B2

(12) United States Patent
Naka et al.

(10) Patent No.: US 6,630,277 B2
(45) Date of Patent: Oct. 7, 2003

(54) TONER PRODUCTION SYSTEM

(75) Inventors: Takeshi Naka, Susono (JP); Momosuke Takaichi, Gotenba (JP); Kiyoshi Kanai, Toride (JP); Tsuneo Nakanishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,506

(22) Filed: Nov. 15, 2001

(65) Prior Publication Data

US 2002/0086231 A1 Jul. 4, 2002

(30) Foreign Application Priority Data

Nov. 15, 2000 (JP) ..... 2000-347410
Nov. 21, 2000 (JP) ..... 2000-354000
Sep. 28, 2001 (JP) ..... 2001-298917

(51) Int. Cl.[7] ..... B02C 7/00; G03G 9/08

(52) U.S. Cl. ..... 430/137.18; 430/137.2; 241/24.18; 241/66; 241/24.28; 241/260

(58) Field of Search ..... 430/137.18, 137.2; 241/24.18, 24.28, 66, 260

(56) References Cited

U.S. PATENT DOCUMENTS 3,464,636 A * 9/1969 Byers ..... 241/27
4,292,387 A 9/1981 Kanbe et al. ..... 430/102
4,356,245 A 10/1982 Hosono et al. ..... 430/122
4,562,972 A * 1/1986 Hagiwara et al. ..... 241/260
4,839,255 A * 6/1989 Hyosu et al. ..... 430/137.18
5,845,855 A * 12/1998 Yamada et al. ..... 241/260

FOREIGN PATENT DOCUMENTS

JP 54-42141 4/1979
JP 55-18656 9/1981

* cited by examiner

*Primary Examiner*—Christopher Rodee
(74) *Attorney, Agent, or Firm*—Fitzpatrick, Cella, Harper & Scinto

(57) ABSTRACT

Coarsely crushed toner particles comprising at least a binder resin and a colorant are effectively pulverized by a mechanical pulverizer including a generally cylindrical rotor rotating about an axis and a stator surrounding the rotor with a minute gap from the rotor. Each of the outer wall of the rotor and the inner wall of the stator is provided with a plurality of grooves which extend generally in parallel with the rotation axis of the rotor and are formed of a wave-shaped plurality of projections and intervening recesses. Each recess on at least one of the rotor and the stator is provided with a flat-shaped bottom between a forward corner and a rear corner adjacent a forward slope and a rear slope respectively, with respect to the rotation direction. One corner (rear corner on the rotor or forward corner on the stator) of the two corners receiving an intense flow of the pulverized feed together with conveying air is provided with a dull angle between the adjacent slope and the flat-bottomed surface for effective pulverization.

26 Claims, 9 Drawing Sheets

TONER PRODUCTION SYSTEM

FIELD OF THE INVENTION AND RELATED ART

The present invention relates to a toner production system (apparatus and process) for producing a toner comprising a binder resin and a colorant for use in an image forming method, such as electrophotography.

In an image forming method, such as electrophotography, electrostatic recording or electrostatic printing, a toner is used for developing electrostatic images.

In a typical type of toner production process, toner ingredients including a binder resin for fixation onto a transfer(-receiving) material, a various colorant for providing a toner hue, a charge control agent for imparting a chargeability to toner particles, and optionally a magnetic material for imparting a conveyability to toner particles for providing a magnetic toner used in a so-called monocomponent developing method (as disclosed in JP-A 54-42141 and JP-A 55-18656) and other optional additives, such as a release agent and a flowability imparting agent, are dry-blended and melt-kneaded by a kneading apparatus, such as a roll mill or an extruder. The melt-kneaded product is, after being cooled for solidification, pulverized by means of a various pulverization apparatus, such as a jet gas stream pulverizer or a mechanical impingement pulverizer, and then classified by a various pneumatic classifier to provide toner particles having a desired particle size distribution. The toner particles are further dry-blended, as desired, with external additives, such as a flowability-improving agent and a lubricating agent, to provide a toner used for image formation. In the case of providing a two-component developer, such a toner may be blended with a various carrier, such as magnetic carrier particles, to be used for image formation.

As the pulverization means, various pulverization apparatus are used, and among these, a jet gas stream pulverizer, particularly an impingement-type pneumatic pulverizer as shown in FIG. 10, has been frequently used for pulverizing a coarsely crushed toner product comprising principally a binder resin.

In such an impingement pneumatic pulverizer using a high-pressure gas stream, such as a jet gas stream, the powdery feed (coarsely crushed product) is ejected out of an acceleration pipe to be impinged onto a surface of an impingement member disposed opposite to the accelerating pipe outlet aperture to pulverize the powdery feed under the impacting force.

For example, in the impingement-type pneumatic pulverizer shown in FIG. 10, an impingement member 164 is disposed opposite to an outlet port 163 of an acceleration pipe 162 connected to a high-pressure gas feed nozzle 161, a powdery material is sucked through a powder material feed port 165 formed intermediate the acceleration tube 162 into the acceleration tube 162 under the action of a high-pressure gas supplied to the acceleration pipe, and the powder material is ejected from the outlet port 163 together with the high-pressure gas to impinge onto the impinging surface 166 of the impingement member 164 to be pulverized under the impact. The pulverized product is discharged out of a discharge port 167.

However, as the powdery material is pulverized by the impacting force caused by the impingement of the powder ejected together with a high-pressure gas onto the impingement member, in order to produce a small particle size toner by using the above-mentioned impingement-type pneumatic pulverizer, a large amount of air is required, thus increasing the electric power consumption which results in an increase in production energy cost. In recent years, economization of toner production energy is also required from an ecological viewpoint.

Accordingly, instead of such a conventional impingement-type pneumatic pulverizer, a mechanical pulverizer not requiring a large amount of air but requiring less electric power consumption has been noted recently.

For example, a mechanical pulverizer shown in FIG. 1 has an organization including at least a rotor affixed to a central rotation shaft, and a stator disposed so as to surround the rotor with a certain spacing from the rotor, so as to provide an air-tight annular space therebetween.

Such a mechanical pulverizer does not require a large amount of air and consumes less power unlike the conventional impingement-type pneumatic pulverizer, so that it can comply with the requirement of energy economization in recent years. Further, the toner particles produced through the pulverization by such a mechanical pulverizer are provided with a rather round shape due to application of mechanical impact during the pulverization, so that the resultant toner is suitable for use in a cleanerless image forming system allowing the suppression of waste toner discharge which is desirable from the viewpoint of anti-pollution.

However, for complying with recent demands for higher quality and higher resolution images required of copying machines and printers, still severer requirements are posed on performance of the toner as a developer. For example, the toner is required to have a smaller particle size and a narrower particle size distribution free from inclusion of coarse particles and containing little ultrafine powder fraction. Further, the toner is required to have a highly controlled surface state of high level of environmental stability. More specifically, there is earnestly desired a system for efficiently providing a small particle size-toner of a sharp particle size distribution suitable for realizing high-resolution and high-definition image formation in an image forming method, such as electrophotography.

SUMMARY OF THE INVENTION

A generic object of the present invention is to provide a system, particularly a process, for efficiently producing a toner capable of providing high-definition and high-quality images.

A more specific object of the present invention is to provide a process capable of providing a toner having a small particle size and a narrow particle size distribution by using a mechanical pulverizer exhibiting a further improved pulverization efficiency.

A further object of the present invention is to provide a process for producing a toner at an excellent efficiency by using a mechanical pulverizer causing a less pressure loss at concave parts of the rotor and/or the stator thereof to exhibit an improved pulverization efficiency.

According to the present invention, there is provided a process for producing a toner, comprising: melt-kneading a mixture comprising at least a binder resin and a colorant to form a kneaded product, cooling the kneaded product, coarsely crushing the cooled kneaded product to provide a crushed product, and pulverizing the crushed product by means of a mechanical pulverizer to provide a toner having a weight-average particle size of 3 to 12 $\mu$m, wherein the mechanical pulverizer includes an inlet port for introducing the crushed product into a pulverization zone to form a pulverizate, a discharge port for discharging the pulverizate out of the pulverization zone, a rotor rotatably supported about a rotation axis and having an outer wall, a stator surrounding the rotor and having an inner wall spaced apart from the outer wall of the rotor so as to form the pulverization zone between the inner wall of the stator and the outer wall of the rotor where the crushed product is pulverized into the pulverizate, each of the outer wall of the rotor and the inner wall of the stator is provided with a plurality of grooves which extend generally in parallel with the rotation axis of the rotor and are formed of a wave-shaped plurality of projections and intervening recesses, so that the recesses of at least one of the outer wall of the rotor and the inner wall of the stator have flat-faced bottoms, and in case where the outer wall of the rotor has the recesses having flat-faced bottoms, each recess of the outer wall has a corner (A) at a rear edge of the flat-faced bottom with respect to the rotation direction of the rotor and adjacent to a rising slope which forms an angle ($\alpha$1) of at least 10 deg. and below 80 deg. in a direction opposite to the rotation direction with respect to a reference line connecting the rotation axis and the corner (A), and in case where the inner wall of the stator has the recesses having flat-faced bottoms, each recess of the inner wall has a corner (A') at a forward edge of the flat-faced bottom with respect to the rotation direction of the rotor and adjacent to a rising slope which forms an angle ($\beta$1) of at least 10 deg. and below 80 deg. in the rotation direction with respect to a reference line connecting the rotation axis of the rotor and the corner (A').

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
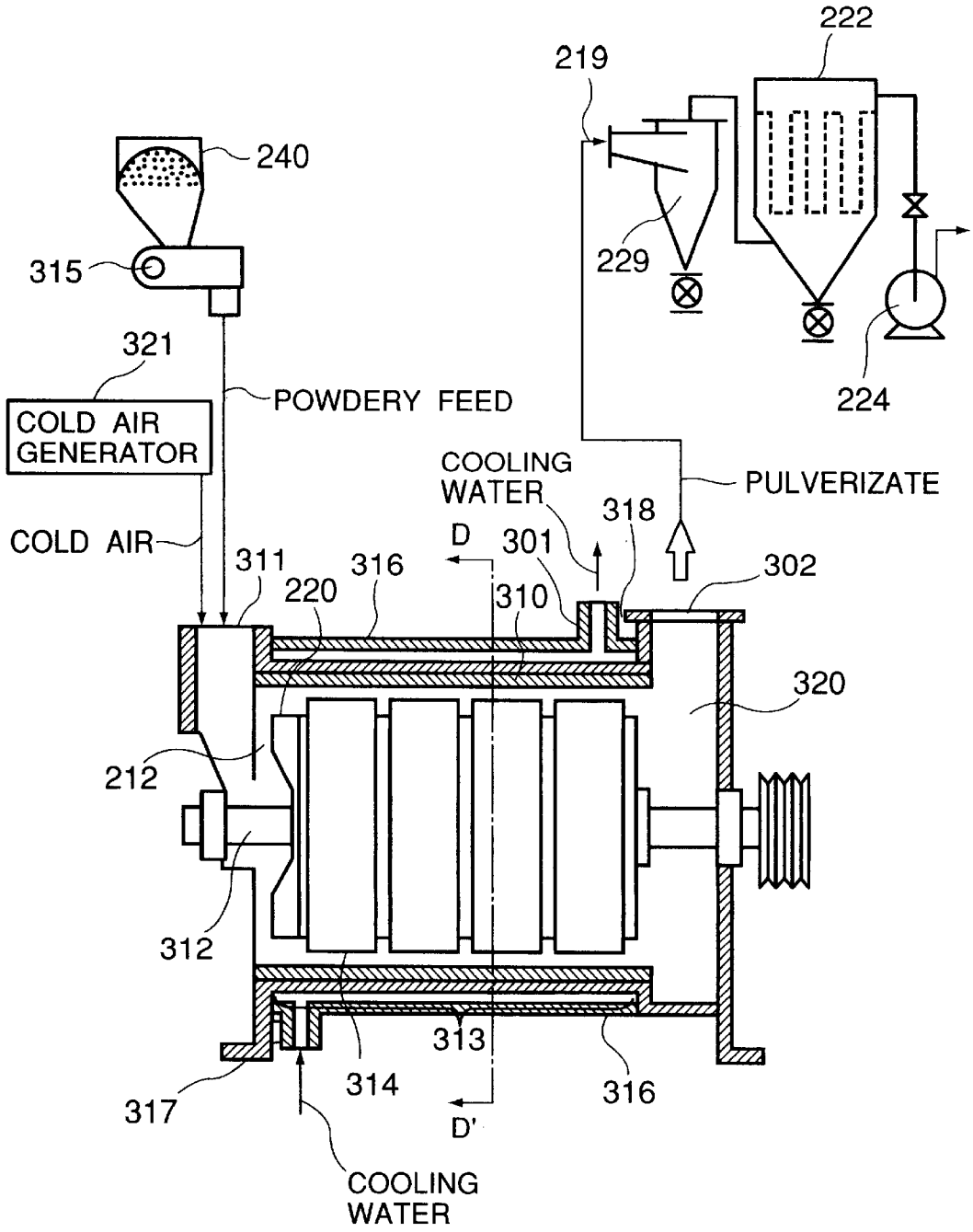
FIG. 1 is an illustration of a pulverization system including a schematic sectional view of a mechanical pulverizer used in a pulverization step in an embodiment of the toner production process according to the invention.

As a result of our study with the above-mentioned objects, it has been found possible to obtain a small-particle size toner having a narrow particle size distribution at an improved pulverization efficiency by using a mechanical pulverizer including a roughly cylindrical rotor having an outer wall and a stator surrounding the rotor and having an inner wall opposite to and with a spacing from the outerwall of the rotor, wherein each of the outer wall of the rotor and the inner wall of the stator is provided with an axially extending plurality of surface grooves formed of a wave-shaped plurality of projections and intervening recesses so that the recesses of at least one of the rotor and the stator have flat-faced bottoms. As a result, it has been found that the area of each recess of the rotor and/or the stator can be enlarged to provide a smaller pressure loss thereat, thereby allowing pulverization at a better efficiency.

Hereinbelow, the present invention will be described in further detail with reference to preferred embodiments.

First of all, ingredients of toner particles comprising at least a binder resin and a colorant will be described.

Binder Resin

The binder resin used in the present invention may comprise various resins known heretofore as toner binder resins. Examples thereof may include: vinyl resin, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and petroleum resin. Among these, vinyl resin and polyester resin are preferred in view of chargeability and fixability.

The vinyl resin may be produced by polymerization of vinyl monomers, examples of which may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethyl-styrene, p-n-butylstyrene, p-tert-butylstyrene, p-n-hexylstyrene, p-n-octylstyrene, p-n-nonylstyrene, p-n-decylstyrene, p-n-dodecylstyrene, m-nitrostyrene, o-nitrostyrene, and p-nitrostyrene; ethylenically unsaturated monoolefins, such as ethylene, propylene, butylene, and isobutylene; unsaturated polylenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinyl-carbazole, N-vinylindole, and N-vinyl pyrrolidone; vinylnaphthalenes; acrylic acid derivatives or methacrylic acid derivatives, such as acrylonitrile, methacryronitrile, and acrylamide; $\alpha,\beta$-unsaturated acids, such as acrylic acid, methacrylic acid, crotonic acid, cinnamic acid, vinylacetic acid, isocrotonic acid and angelic acid, and $\alpha$- or $\beta$-alkyl derivatives and esters of these acids; and unsaturated dibasic acids, such as fumaric acid, maleic acid, citraconic acid, alkenylsuccinic acid, itaconic acid, mesaconic acid, dimethylmaleic acid and dimethyl-fumaric acid, and monoesters, diesters and anhydrides. These vinyl monomers may be used singly or in combination of two or more species to provide a vinyl resin. Among the above, a combination of monomers providing a styrene copolymer or a styrene-acrylate copolymer, may preferably be used.

The binder resin used in the present invention can include a crosslinking structure obtained by using a crosslinking monomer having two or more vinyl groups, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)-methacrylate propanediacrylate, compounds obtained by substituting groups for the acrylate groups in the above compounds, and polyester-type diacrylates (e.g., one available under the trade name of "MANDA" from Nippon Kayaku K.K.).

Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

Polyester resin is another preferred class of binder resin used in the present invention and may preferably comprises 45–55 mol. % of alcohol component and 55–45 mol. % of acid component.

Examples of the alcohol component may include: dihydric alcohols, such as, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (B):

(B)

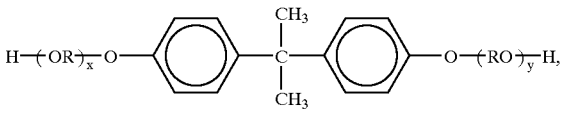

wherein R denotes an ethylene or propylene group, x and y are independently an integer of at least 1 with the proviso that the average of x+y is in the range of 2–10; diols represented by the following formula (C):

(C)

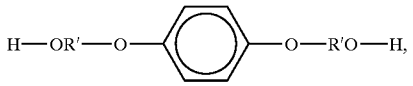

wherein R' denotes —$CH_2CH_2$—,

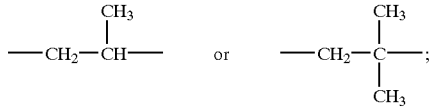

and polyhydric alcohols, such as glycerin, sorbitol and sorbitane.

Examples of the acid component may include: dibasic acids, inclusive of benzenedicarboxylic acids such as phthalic acid, terephthalic acid, isophthalic acid and phthalic anhydride, and anhydrides thereof; alkyldicarboxylic acids, such as succinic acid, adipic acid, sebacic acid, and azelaic acid, and their anhydrides; and unsaturated dicarboxylic acids, such as fumaric acid, maleic acid, citraconic acid and itaconic acid, and their anhydrides; and poly-carboxylic acids, such as trimellitic acid, pyromellitic acid and benzophenonetetracarboxylic acid.

A particularly preferred class of polyester resin may be formed by polycondensation of a bisphenol derivative represented by the above formula (B) as an alcohol component with an acid component selected from: dibasic acids, such as phthalic acid, terephthalic acid, isophthalic acid, succinic acid, n-dodecenylsuccinic acid, fumaric acid, maleic acid and anhydrides of these, and tribasic acids, such as trimellitic acid and anhydride thereof, because of good fixability and anti-offset characteristic when used as a toner for hot-roller fixation.

Wax

The toner particles may preferably contain a wax as a release agent which may be selected from various known waxes. Examples thereof may include the following:

aliphatic hydrocarbon waxes, such as hydrocarbon waxes, inclusive of low-molecular weight polyethylene, low-molecular weight polypropylene, polyolefin copolymers, polyolefin wax, microcrystalline wax, paraffin wax, and Fischer-Tropsche wax;

waxes having a functional group, inclusive of oxides of aliphatic hydrocarbon waxes, such as oxidized polyethylene wax, and block copolymers of these; waxes principally comprising aliphatic acid esters, such as montaic acid ester wax and castor wax; vegetable waxes, such as candelilla wax, carnauba wax and wood wax; animal waxes, such as bees wax, lanolin and whale wax; mineral waxes, such as ozocerite, ceresine, and petroractum; partially or wholly deacidified aliphatic acid esters, such as deacidified carnauba wax;

further, saturated linear aliphatic acids, such as palmitic acid, stearic acid and montaic acid and long-chain alkylcarboxylic acids having longer chain alkyl groups; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol and long-chain alkyl alcohols having longer chain alkyl groups; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat; and grafted waxes, as formed by grafting aliphatic hydrocarbon waxes with vinyl monomers, such as styrene and acrylic acid.

Examples of preferably usable waxes may include: polyolefins obtained by radical polymerization of olefins under high pressure; polyolefins obtained by purification of low-molecular weight by-products obtained in polymerization for high-molecular weight polyolefins; polyolefins polymerized under low pressure by using catalysts such as a Ziegler catalyst or a metallocene catalyst; polyolefins polymerized under irradiation with radiation, electromagnetic wave or light; low-molecular weight polyolefin by thermal decomposition of high-molecular weight polyolefin; paraffin wax, microcrystalline wax, Fischer-Tropsche wax; synthetic hydrocarbon waxes, such as those synthesized through the Synthol process, the Hydrocol process and the Arge process; synthetic wax obtained from mono-carbon compound; hydrocarbon waxes having a functional group, such as a hydroxyl group or carboxyl group; mixtures of hydrocarbon waxes and functional group-containing waxes; and waxes obtained by grafting onto these waxes with vinyl monomers, such as styrene, maleic acid esters, acrylates, methacrylates and maleic anhydride.

It is also preferred to use a wax having a narrower molecular weight distribution or a reduced amount of impurities, such as low-molecular weight solid aliphatic acid, low-molecular weight solid alcohol, or low-molecular weight solid compound, by the press sweating method, the solvent method, recrystallization, vacuum distillation, supercritical gas extraction or fractionating crystallization.

Colorant

The toner produced by the process of the present invention contains a colorant which can be a magnetic material or another colorant.

Magnetic Material

The toner can be constituted as a magnetic toner by containing a magnetic material as a colorant. For this purpose, an ordinary magnetic material may be used, and examples thereof may include: iron oxides, such as magnetite, hematite and ferrite; and other metal-containing iron oxides; metals, such as Fe, Co and Ni, alloys of these metals with metals, such as Al, Co, Cu, Pb, Mg, Ni, Sn, Zn, Sb, Be, Bi, Cd, Ca, Mn, Se, Ti, W and V, and mixtures of these.

More specific examples of magnetic materials may include: triiron tetroxide ($Fe_3O_4$), diiron trioxide (gamma-$Fe_2O_3$), iron zinc oxide ($ZnFe_2O_4$), iron yttrium oxide ($Y_3Fe_5O_{12}$), calcium iron oxide ($CdFe_2O_4$), gadolinium iron oxide ($Gd_3Fe_5O_{12}$), copper iron oxide ($CuFe_2O_4$), iron lead oxide ($PbFe_{12}O_{19}$), iron nickel oxide ($NiFe_2O_4$), iron neodium oxide ($NdFe_2O_3$), barium iron oxide ($BaFe_{12}O_{19}$), iron magnesium oxide ($MgFe_2O_4$), iron manganese oxide ($MnFe_2O_4$), iron lanthanum oxide ($LaFeO_3$), iron (Fe), cobalt (Co), and nickel (Ni). These magnetic materials are used in a fine powdery form. Especially preferred magnetic materials may include: fine powders of triiron tetroxide, magnetic ferrite and gamma-diiron trioxide.

The magnetic material may preferably have an average particle size of 0.05–2 $\mu$m, and magnetic properties inclusive of a coercive force of 1.6–12.0 kA/m, a saturation magnetization of 50–200 $Am^2/kg$, more preferably 50–100 $Am^2/kg$, and a residual magnetization of 2–20 $Am^2/kg$ when measured by applying a magnetic field of 795.8 kA/m (10 k-oersted).

The magnetic material may preferably be contained in 60–200 wt. parts, more preferably 80–150 wt. parts, per 100 wt. parts of the binder resin.

Other Colorants

The toner can also contain another colorant, which may be an arbitrarily selected appropriate pigment or dye. Examples of the pigment may include: carbon black, aniline black, acetylene black, Naphthol Yellow, Hansa Yellow, Rhodamine Lake, red iron oxide, Phthalocyanine Blue and Indanthrene Blue. Such a pigment may be contained in 0.1–20 wt. parts, preferably 1–10 wt. parts, per 100 wt. parts of the binder resin. It is also possible to use a dye in an amount of 0.1–20 wt. parts of the binder resin.

More specifically, a black colorant may comprise carbon black, a magnetic material, and a black colored mixture of yellow/magenta/cyan colorants as described below.

Examples of the yellow colorant may include: pigments comprising compounds represented by condensed azo compounds, isoindolinone compounds, anthraquinone compounds, azo metal complex, methine compounds and arylamide compounds. Specific pigments suitably used may include: C.I. Pigment Yellow 12, 13, 14, 15, 17, 62, 74, 83, 93, 94, 95, 97, 109, 110, 111, 120, 127, 128, 129, 147, 168, 170, 176, 180, 181, and 191.

Examples of the magenta colorant may include: condensed azo compounds, diketopyrrolopyrrole compounds, anthraquinone, quinacridone compounds, basic dye lake compounds, naphthol compounds, benzimidazolone compounds, thioindigo compounds and perylene compounds. Particularly preferred pigments may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compound and derivatives thereof, anthraquinone compounds, and basic dye lake compounds. Particularly suitably usable pigments may include: C.I. Pigment Blue 1, 7, 15, 15:1, 15:2, 15:3, 15:4, 60, 62 and 66.

Charge Control Agent

The toner can contain a charge control agent, as desired, so as to further stabilize the chargeability, in an amount of 0.1–10 wt. parts, preferably 1–5 wt. parts, per 100 wt. parts of the binder resin.

The charge control agent may be selected from various known charge control agents, examples of which are enumerated below.

As negative charge control agents for providing a negatively chargeable tone, organometallic complexes or chelate compounds, for example, are effective. Examples thereof may include: monoazo metal complexes, metal complexes of aromatic hydroxy-carboxylic acids, and metal complexes of aromatic dicarboxylic acids. Other examples may include: aromatic hydroxycarboxylic acids, aromatic mono- and polycarboxylic acids, and metal salts, anhydride, and esters of these acids, and bisphenol derivatives A preferred class of monoazo metal compounds may be obtained as complexes of monoazo dyes synthesized from phenol or naphthol having a substituent such as alkyl, halogen, nitro or carbamoyl with metals, such as Cr, Co and Fe. It is also possible to use metal compounds of aromatic carboxylic acids, such as benzene-, naphthalene-, anthracene- and phenanthrene-carboxylic acids having a substituent of alkyl, halogen, nitro, etc.

As a specific class of negative charge control agents, it is preferred to use an azo metal complex of formula (1) below or a basic organic acid metal complex of formula (2) below:

(1)

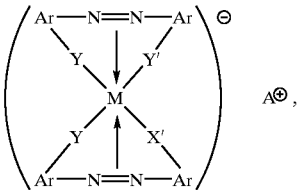

wherein M denotes a coordination center metal selected from the group consisting of Sc, V, Cr, Co, Ni, Mn, Fe, Ti and Al; Ar denotes an aryl group capable of having a substituent, selected from include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^+$ denotes a hydrogen, sodium, potassium, ammonium or aliphatic ammonium ion or a mixture of such ions.

(2)

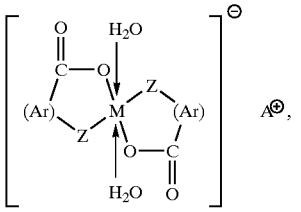

wherein M denotes a coordination center metal selected from the group consisting of Cr, Co, Ni, Mn, Fe, Ti, Zr, Zn, Si, B and Al; Ar denotes an aryl group capable of having a substituted selected from nitro, halogen, carboxyl, anilide and alkyls and alkoxyles having 1–18 carbon atoms; Z denotes —O— or —CO—O—; and $A^+$ denotes a hydrogen, sodium potassium, ammonium or aliphatic ammonium ion, or a mixture of such ions.

On the other hand, examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologues inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate guanidine compounds; and imidazole compounds. These may be used singly or in mixture of two or more species. Among the above, it is preferred to use a triphenylmethane compound or a quaternary ammonium salt having a non-halogen counter ion. It is also possible to use a homopolymer or a copolymer with a polymerizable monomer, such as styrene, acrylate ester or methacrylate ester as mentioned above of a monomer represented by the following formula (3):

(3)

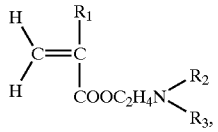

wherein $R_1$ denotes H or $CH_3$, and $R_2$ and $R_3$ denote a substituted or non-substituted alkyl group (of preferably $C_1$–$C_4$). In this case, such a homopolymer or copolymer may function as a charge control agent and also as a part or whole of the binder resin.

A compound represented by the following formula (4) may also be preferably used as a positive charge control agent:

(4)

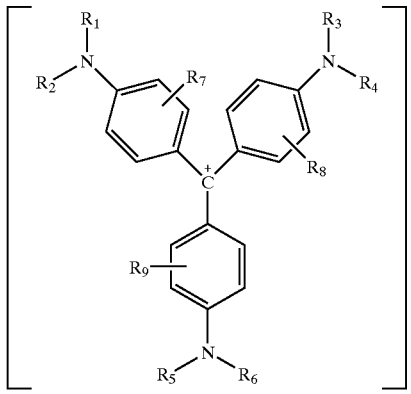

when $R_1$–$R_6$ independently denote a hydrogen atom, a substituted or non-substituted alkyl group, or a substituted or non-substituted aryl group; $R_7$–$R_9$ independently denote a hydrogen atom, a halogen atom, an alkyl group, or an alkoxy group; and A– denotes an anion such as sulfate, nitrate, borate, phosphate, hydroxyl, organo-sulfate, organo-sulfonate, organo-phosphate, carboxyl, organo-borate or tetrafluoro-borate ion.

Such a charge control agent may be integrally incorporated in or externally added to toner particles in an amount which may vary depending on the species of the binder resin, other additives and toner production processes inclusive of dispersion method but may preferably be 0.1–10 wt. parts, more preferably 0.1–5 wt. parts, per 100 wt. parts of the binder resin.

Now, a process of producing a toner from the above-mentioned toner ingredients will be described.

First of all, in a blending step, toner ingredients for producing toner particles including at least a binder and a colorant weighed in prescribed amounts are blended by a blender, examples of which may include: a double-cone mixer, a V-shaped mixer, a drum-type mixer, Super Mixer (made by Kawata K.K.), a Henschel mixer, and Nantamixer (made by Hosokawa Micron K.K.).

The above-blended toner ingredients are then melt-kneaded to melt the resin, etc., and disperse therein a colorant, etc. For the melt-kneading, it is possible to use a batch-wise kneading machine, such as a pressure kneader or a Banbury mixer; or a continuous kneading machine. In recent years, in view of advantages, such as continuous production, the use of a single-screw or a twin-screw extruder is becoming popular. Commercially available examples thereof may include: "KTK twin-screw extruder" (made by Kobe Seikosho K.K.), "TEM twin-screw extruder" (made by Toshiba Kikai K.K.), a twin-screw extruder (made by K.C.K. K.K.) and "KO-KNEADER" (made by Buss A.G.). The thus-melt-kneaded toner ingredients or cooled resinous composition may be rolled by means of a two-roller mill, etc., and cooled as by water-cooling.

The cooled, colored resinous composition is then pulverized down to a desired particle size. In the pulverization step, the colored resinous composition is first coarsely crushed by means of a crusher, a hammer mill, a feather mill, etc., and then finely pulverized by a mechanical pulverizer to a prescribed level of toner particle size. Then, the pulverized composition is then classified into toner particles having a weight-average particle size (D4) of 3–12 $\mu$m, preferably 4–12 $\mu$m, by means of a classifier, e.g., an inertia-type classifier or multi-division pneumatic classifier, such as "Elbow Jet" (made by Nittetsu Kogyo K.K.), a centrifugal classifier, such as "Mikroplex" (made by K.K. Powrex), or "DS Separator" (made by Nippon Pneumatic Kogyo K.K.). Among the above, a multi-division pneumatic classifier is particularly preferred.

Figure 9:
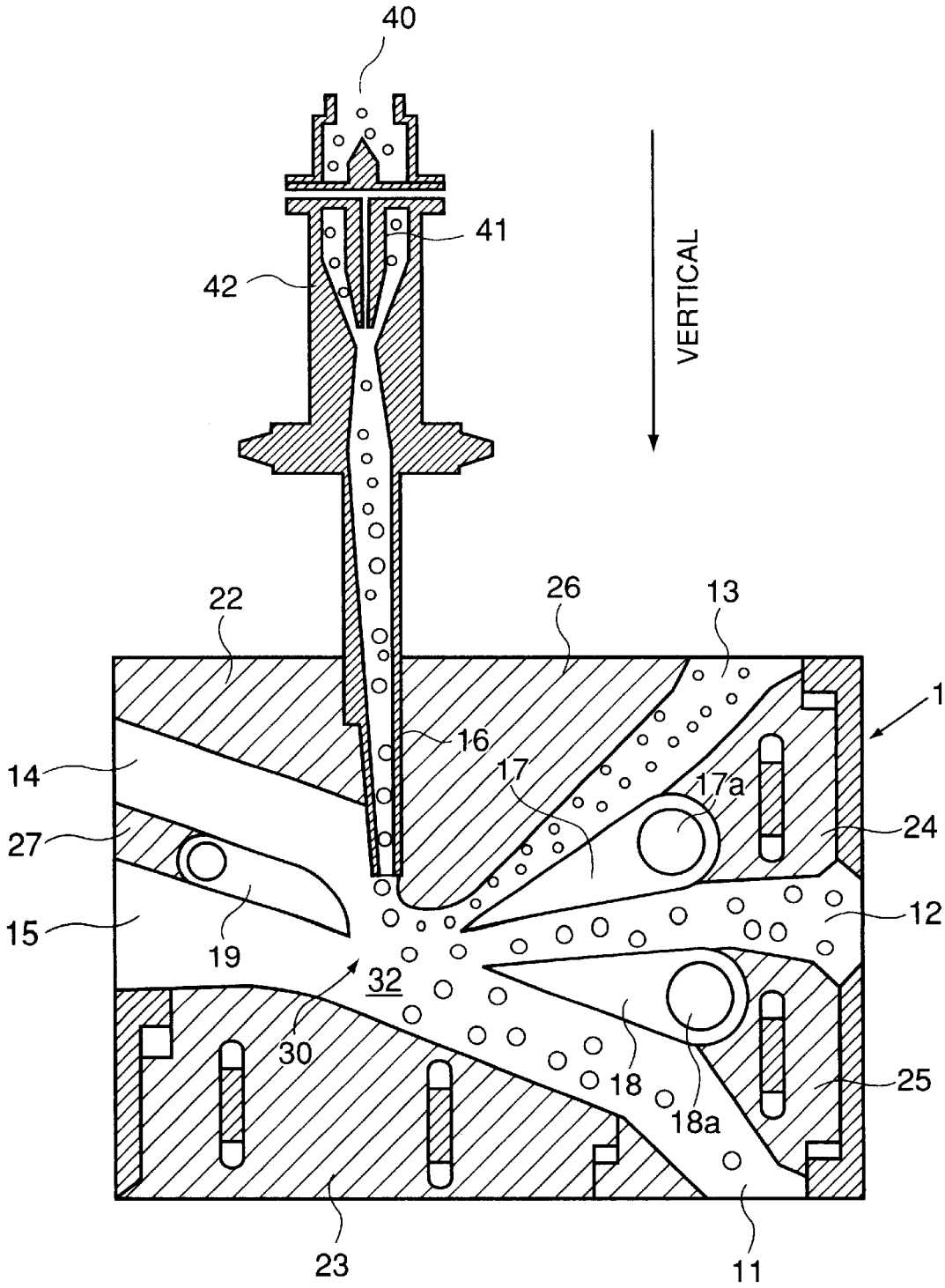
FIG. 9 is a schematic sectional view of a multi-division pneumatic classifier preferably used in a classification step of a process of the invention.
Figure 10:
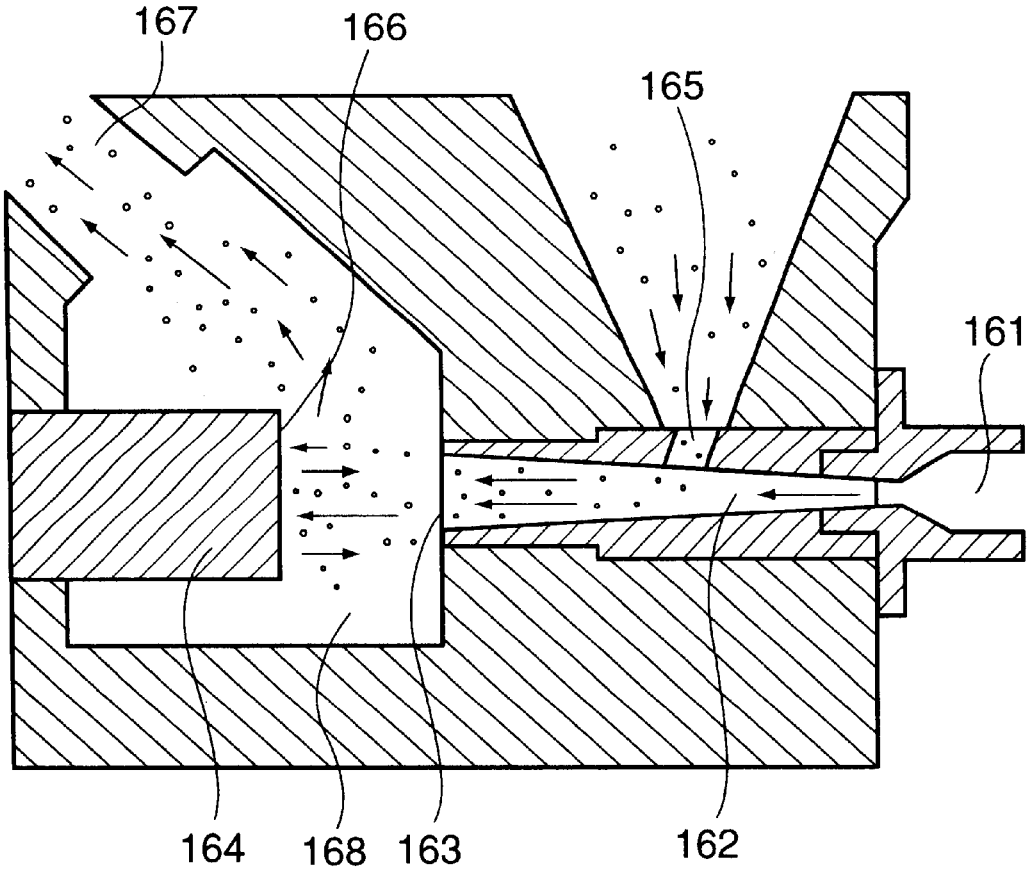
FIG. 10 is a schematic partial sectional view of a conventional impingement-type pneumatic pulverizer.

FIG. 9 is a sectional view of an embodiment of a preferred multi-division pneumatic classifier.

Referring to FIG. 9, the classifier includes a side wall 22 and a G-block 23 defining a portion of the classifying chamber, and classifying edge blocks 24 and 25 equipped with knife edge-shaped classifying edges 17 and 18. The G-block 23 is disposed slidably laterally. The classifying edges 17 and 18 are disposed swingably about shafts 17*a* and 18*a* so as to change the positions of the classifying edge tips. The classifying edge blocks 17 and 18 are slidable laterally so as to change horizontal positions relatively together with the classifying edges 17 and 18. The classifying edges 17 and 18 divide a classification zone of the classifying chamber 32 into 3 sections.

A feed port 40 for introducing a powdery feed is positioned at the nearest (most upstream) position of a feed supply nozzle 16, which is also equipped with a high-pressure air nozzle 41 and a powdery feed-introduction nozzle 42 and opens into the classifying chamber 32. The nozzle 16 is disposed on a right side of the side wall 22, and a Coanda block 26 is disposed so as to form a long elliptical arc with respect to an extension of a lower tangential line of the feed supply nozzle 16. A left block 27 with respect to the classifying chamber 32 is equipped with a gas-intake edge 19 projecting rightwards in the classifying chamber 32. Further, gas-intake pipes 14 and 15 are disposed on the left side of the classifying chamber 32 so as to open into the classifying chamber 32.

The positions of the classifying edges 17 and 18, the G-block 23 and the gas-intake edge 18 are adjusted depending on the pulverized powdery feed to the classifier and desired particle size of the product toner.

On the right side of the classifying chamber 32, there are disposed exhaust ports 11, 12 and 13 communicative with the classifying chamber corresponding to respective classified fraction zones. The exhaust ports 11, 12 and 13 are connected with communication means such as pipes which can be provided with shutter means, such as valves, as desired.

The feed supply nozzle 16 may comprise an upper straight tube section and a lower tapered tube section. The inner diameter of the straight tube section and the inner diameter of the narrowest part of the tapered tube section may e set to a ratio of 20:1 to 1:1, preferably 10:1 to 2:1, so as to provide a desirable introduction speed.

The classification by using the above-organized multi-division classifier may be performed in the following manner. The pressure within the classifying chamber 32 is reduced by evacuation through at least one of the exhaust ports 11, 12 and 13. The powdery feed is introduced through the feed supply nozzle 16 at a flow speed of preferably 10–350 m/sec under the action of a flowing air caused by the reduced pressure and an ejector effect caused by compressed air ejected through the high-pressure air supply nozzle and ejected to be dispersed in the classifying chamber 32.

The particles of the powdery feed introduced into the classifying chamber 32 are caused to flow along curved lines under the action of the Coanda effect exerted by the Coanda block 26 and the action of introduced gas, such as air, so that coarse particles form an outer stream to provide a first fraction outside the classifying edge 18, medium particles form an intermediate stream to provide a second fraction between the classifying edges 18 and 17, and fine particles form an inner stream to provide a third fraction inside the classifying edge 17, whereby the classified coarse particles are discharged out of the exhaust port 11, the medium particles are discharge out of the exhaust port 12 and the fine particles are discharged out of the exhaust port 13, respectively.

In the above-mentioned powder classification, the classification (or separation) points are principally determined by the tip positions of the classifying edges 17 and 18 corresponding to the lowermost part of the Coanda block 26, while being affected by the suction flow rates of the classified air stream and the powder ejection speed through the feed supply nozzle 16.

In the multi-division pneumatic classifier, the feed supply nozzle 16, the powdery feed-introduction nozzle 42 and the high-pressure air nozzle 41 are disposed above the multi-division pneumatic classifier, and the classifying edge blocks 24 and 25 equipped with the classifying edges 17 and 18 are designed to change the shape of the classifying zone by changing the positions of the classifying edges, the classification accuracy can be remarkably increased compared with conventional pneumatic classifiers.

The coarse powder fraction resulted in the classification step may be recycled to the pulverization step for further pulverization. It is possible to re-utilize the fine powder fraction by recycling it to the toner ingredient formulation or blending step.

In the toner production process according to the present invention, the thus-obtained toner particles having a weight-average particle size (D4) of 3–12 $\mu$m may be blended with at least inorganic fine particles having an average particle size of at most 150 nm as an external additive to obtain an objective toner product. For the blending of such an external additive, the toner particles and prescribed amounts of various external additives may be mixed under stirring by means of a high-speed stirrer capable of exerting a shearing force to the particles to be treated, such as a Henschel mixer and a super mixer. In this instance, heat is generated in the blending apparatus, these being liable to cause agglomerates, so that it is preferred to effect a temperature control as by water cooling from outside the vessel of the blending apparatus.

Next, a mechanical pulverizer used in the pulverization step for producing toner particles and the toner production process using the mechanical pulverizer according to the present invention will be described.

Figure 2:
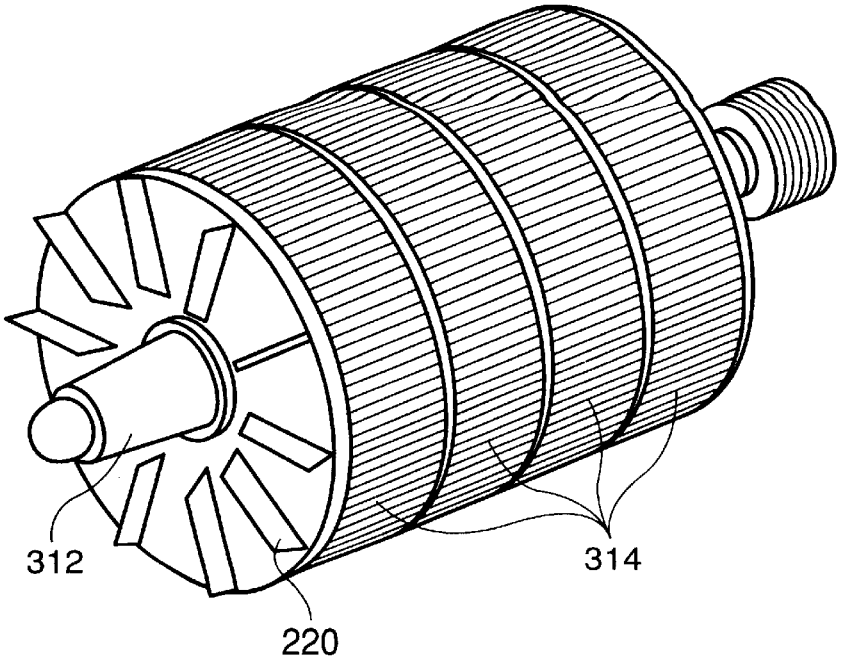
FIG. 2 is a perspective view of a rotor in the mechanical pulverizer shown in FIG. 1.
Figure 3:
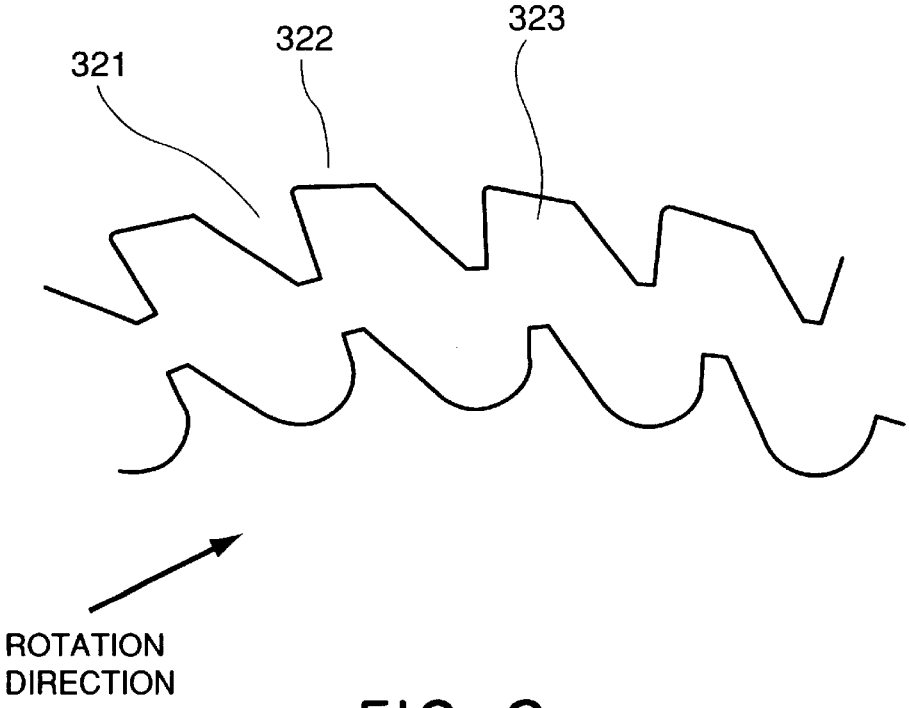
FIGS. 3 to 5 are respectively a partial schematic sectional view of a D–D' section in FIG. 1 of an embodiment of mechanical pulverizer used in the invention.
Figure 4:
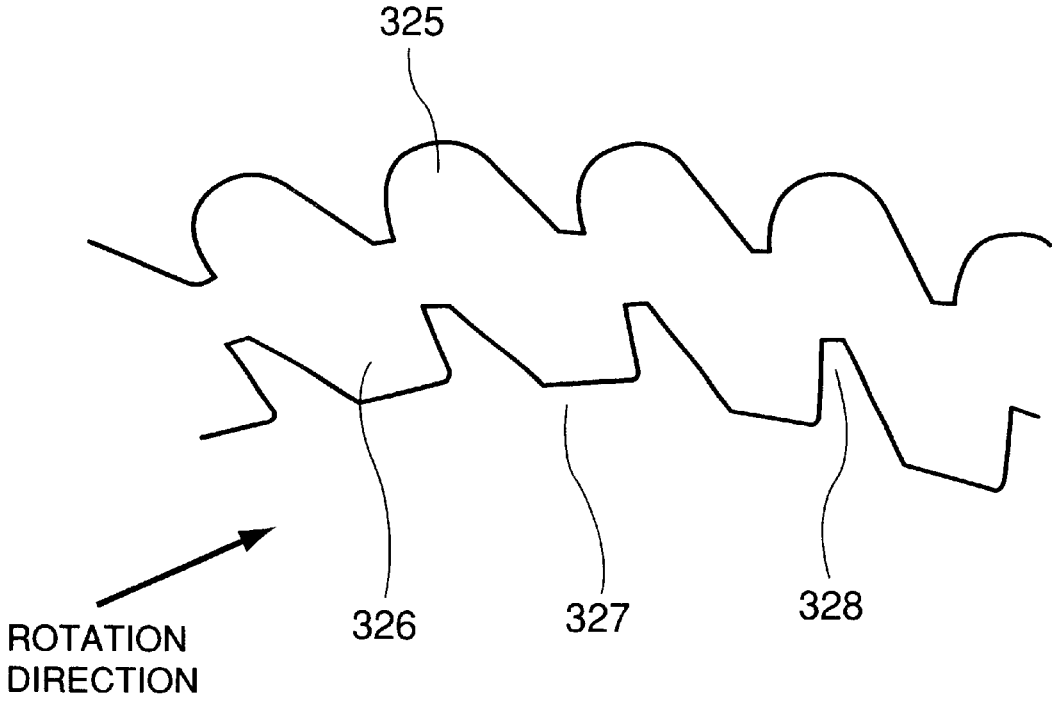
Figure 5:
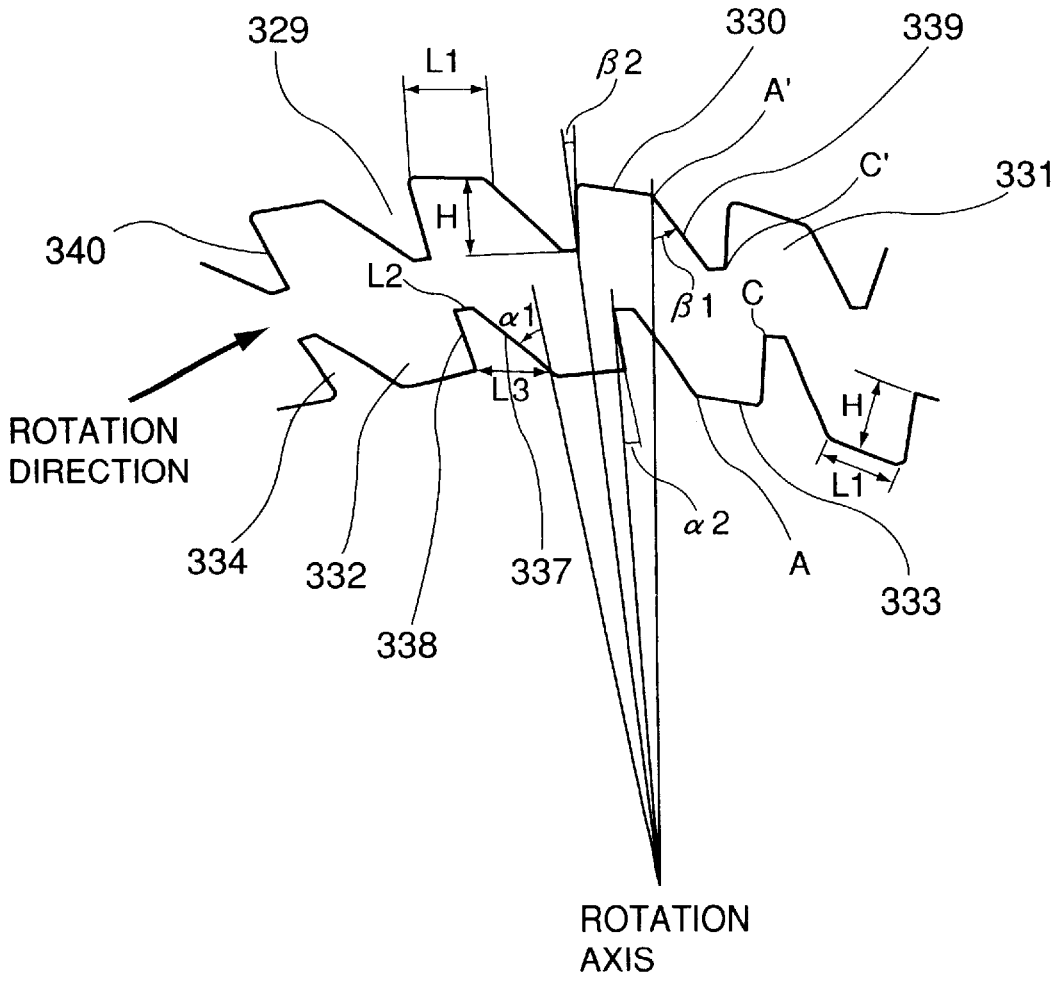

FIG. 1 illustrates an embodiment of pulverization system including such a mechanical pulverizer used in the present invention, FIG. 2 is a perspective view of a high-speed rotor in the mechanical pulverizer, and FIGS. 3 to 5 are respectively a partial schematic sectional view of a D–D' section in FIG. 1 of an embodiment of the mechanical pulverizer.

As shown in FIG. 1, the pulverizer includes a casing 313; a jacket 316; a distributor 220; a rotor 314 comprising a rotating member affixed to a control rotation shaft 312 and disposed within the casing 313, the rotor 314 being provided with a large number of surface grooves (as shown in FIG. 5) and designed to rotate at a high speed; a stator 310 disposed with prescribed spacing from the circumference of the rotor 314 so as to surround the rotor 314 and provided with a large number of surface grooves; a feed port 311 for introducing the powdery feed; and a discharge port 302 for discharging the pulverized material. The same between the rotor 314 and the stator 310 forms a pulverization zone or a processing chamber.

In operation, a powdery feed is introduced at a prescribed rate from the feed port 311 into a processing chamber, where the powdery feed is pulverized in a moment under the action of an impact caused between the rotor 314 rotating at a high speed and the stator 310 respectively provided with a large number of surface grooves, a large number of ultra-high speed eddy flows occurring thereafter and a high-frequency pressure vibration caused thereby. The pulverized product is discharged out of the discharge port 302. Air conveying the powdery feed flows through the processing chamber, the discharge port 302, a pipe 219, a collecting cyclone 209, a bag filter 222 and a suction blower 224 to be discharged out of the system. In the process of the present invention, the powdery feed (coarsely crushed product) is thus easily pulverized without causing increases of fine powder fraction and coarse powder fraction.

Basic models of such a mechanical pulverizer may be commercially provided as, e.g., "Inomizer" (made by Hosokawa Micron K.K.), "Kryptron" (made by Kawasaki Jukogyo K.K.) and "Turbomill" (made by Turbo Kogyo K.K.).

As shown in any one of FIGS. 3 to 5, the mechanical pulverizer used in the process of the present invention is characterized by including a generally cylindrical rotor having an outer wall and a stator surrounding the rotor and having an inner wall opposite to and with a spacing from the outer wall of the rotor, wherein each of the outer wall of the rotor and the inner wall of the stator is provided with an axially extending plurality of surface grooves formed of a wave-shaped plurality of projections and a plurality of recesses each between neighboring projections so that the recesses of at least one of the rotor and the stator have flat-faced bottoms. As a result, the sectional area of each recess can be enlarged to provide a smaller pressure loss thereat, where pulverization at better efficiency can be realized compared with a conventional mechanical pulverizer.

Figure 6:
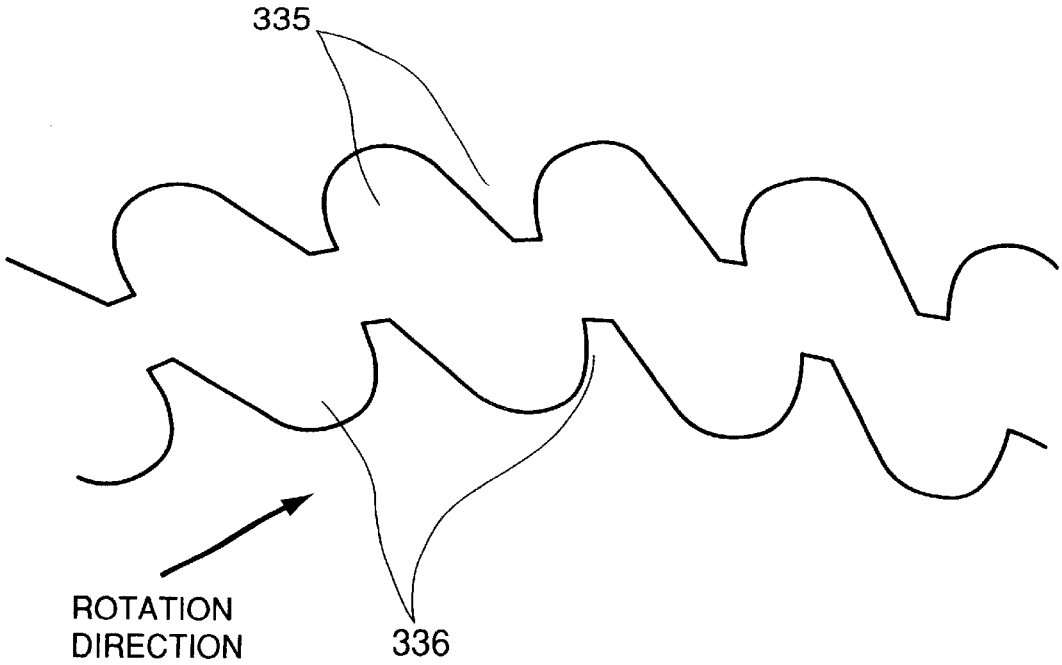
FIGS. 6 to 8 are respectively a partial schematic sectional view of a D–D' section shown in FIG. 1 of a conventional mechanical pulverizer.
Figure 7:
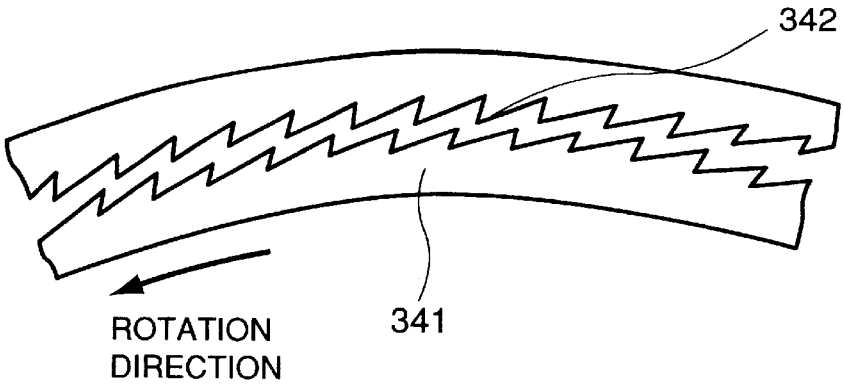
Figure 8:
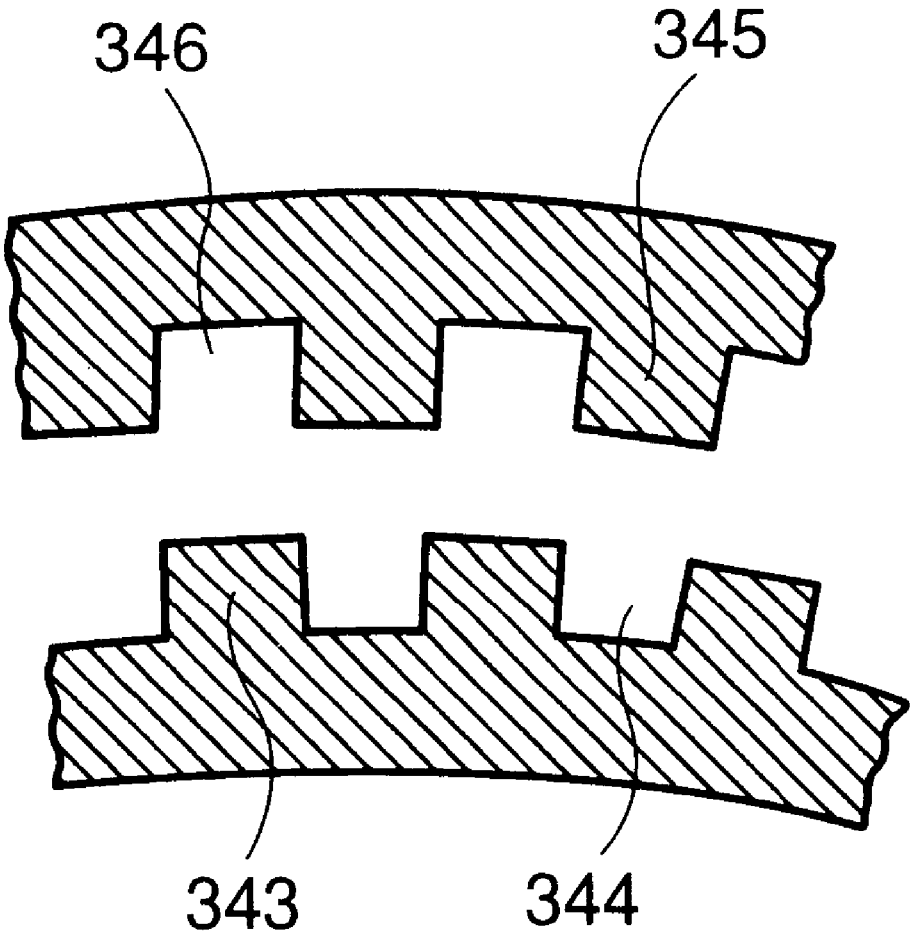

More specifically, compared with pulverization wall- or surface-shapes of the rotor/stator of conventional mechanical pulverizers as shown in FIGS. 6 to 8, the pulverization wall- or surface-shapes of the rotor and/or the stator used in the present invention are characterized by recesses having a flat bottom-face (as shown in FIGS. 3 to 5), whereby each recess is caused to have a sectional shape of a trapezoid having an enlarged width so that the pressure loss thereat is reduced to cause a stronger impact generated between the rotor and the stator, thereby improving the pulverization efficiency.

As a result, a level of particle size distribution obtained by using a conventional mechanical pulverizer can be realized at a higher throughput (i.e., a higher pulverization feed rate), thereby allowing an improved toner production efficiency.

In the present invention, each recess on the outer wall of the rotor and/or the inner wall of the stator is provided with a slope at a corner adjacent to the flat-faced bottom portion forming a specific angle with respect to a reference line connecting the corner and the rotation axis of the rotor. This is explained more specifically with reference to FIG. 5 which illustrates an embodiment wherein both the rotor and stator have recesses having a flat-faced bottom portion on their pulverization surfaces (i.e., the outer wall of the rotor and the inner wall of the stator).

Referring to FIG. 5, the outer wall of the rotor is provided with a plurality of grooves formed of a wave-shaped plurality of projections 334 and intervening recesses each having a flat-faced bottom 333 having a width or length L1 and a trapezoidal section 332. Each recess further has a corner (A) at a rear edge of the flat-faced bottom 333 with respect to the rotation direction of the rotor and adjacent to a rising slope (first slope) 337 which forms an angle ($\alpha 1$) of at least 10 deg. and below 80 deg., preferably around 45 deg., in a direction opposite to the rotation direction with respect to a reference line connecting the rotation axis and the corner (A).

Moreover, the inner wall of the stator is a plurality of grooves formed of a wave-shaped plurality of projections 329 and intervening recesses each having a flat-faced bottom 330 having a width or length L1 and a trapezoidal section 331. Each recess further has a corner (A') at a forward edge of the flat-faced bottom 330 with respect to the rotation direction of the rotor and adjacent to a rising slope (first slope) 339 which forms an angle ($\beta 1$) of at least 10 deg. and below 80 deg., preferably around 45 deg., with respect to a reference line connecting the rotation axis and the corner (A').

In the embodiment shown in FIG. 3, the inner wall of the stator having recesses 323 including a flat-faced bottom 32 satisfies the above-mentioned condition described with reference to FIG. 5. In the embodiment shown in FIG. 4, the outer wall of the rotor having recesses 326 including a flat-faced bottom 327 satisfies the above-mentioned condition described with reference to FIG. 5.

As a result, of two corners sandwiching a flat-faced bottom portion of each recess, a corner (a rear corner (A) in the rotor and a forward corner (A') on the stator, respectively with respect to the rotation direction) receiving an intense flow of air and powdery feed is provided with a dull angle where the whirling stream effectively occurs at a high speed to increase the pulverization efficiency.

For achieving a more effective pulverization stream of powdery feed, it is preferred that a flat-bottomed recess on the rotor has a forward slope (second slope) 338 forming an angle ($\alpha 2$) of below 20 deg., preferably around 10 deg., in the rotation direction with respect to a reference line connecting the rotation axis with a top (C) of the forward slope 338 (FIG. 5). For the same reason, it is preferred that a flat-bottomed recess on the stator has a rear slope (second slope) 340 forming an angle (β2) of below 20 deg., preferably around 10 deg., in a direction opposite to the rotation direction with respect to a reference line connecting the rotation axis and a top (C') of the rear slope 340 (FIG. 5).

It is also preferred that each projection on the rotor and the stator has a height H of 1.00 to 3.00 mm, and each recess on the rotor and the stator has a flat-faced bottom length (or width) L1 in a range of 0.60 to 2.00 mm as viewed in a section perpendicular to the rotation axis. It is further preferred to satisfy a relationship of:

$$0.25H \leqq L1 \leqq 2.5H.$$

It is further preferred that each projection on the rotor and/or the stator has a tapered cross-section, i.e., a top width L2 and a root width L3 satisfying L2<L3.

By satisfying the above-mentioned conditions, it becomes possible obtain toner particles having a particle size distribution obtained by a conventional mechanical pulverizer at a higher throughput (i.e., a higher feed supply rate), thus providing an improved toner production efficiency.

According to a preferred embodiment of the present invention including the use of a mechanical pulverizer as described above and a multi-division pneumatic classifier, it becomes possible to form a toner containing at least 80% by volume of toner particles in a volume-basis particle size range of from 3.17 μm to 10.1 μm and showing an average circularity (Cav.) of at least 0.73, preferably at least 0.74, and at most 0.90, preferably at most 0.80, an average unevenness-1 of 1.07 to 1.15 and an average unevenness-2 of 1.03 to 1.08.

By providing toner particles satisfying the above-mentioned conditions of average circularity, average unevenness-1 and average unevenness-2 through the use of the mechanical pulverizer and the multi-division pneumatic classifier shown in FIG. 9, it becomes possible to obtain a long-life toner which shows good developing performance and transferability from the initial stage and a stable chargeability in various environments including a low temperature/low humidity environment and a high temperature/high humidity environment. The toner can also exhibit suppressed fog at non-image parts and excellent continuous image forming performances capable of providing high-density images from the initial stage and after standing.

Herein, the average circularity (Cav) of toner particles refers to an average of circularity (Ci) values of individual toner particles calculated by the following equation:

$$Ci=(4\times A)/\{(ML)^2\times\pi\},$$

wherein ML denotes a maximum length of a particle projection image, and A denotes a particle projection image area.

Further, the average unevenness-1 and the average unevenness-2 refer to averages of unevenness-1 and unevenness-2, respectively, calculated according to the following formulae:

$$\text{Unevenness-1}=L^2/(4\times\pi\times A)$$

$$\text{Unevenness-2}=L/C$$

wherein L denotes a peripheral length of a particle projection image, A denotes a particle projection image area and C denotes a particle image envelope peripheral length.

More specifically, the above-mentioned values of average circularity, average unevenness-1 and average unevenness-2 have been determined based on respective values measured by inputting optically enlarged toner particle image data into an image analyzer to determine circle-equivalent diameters ($D_{CE}=(4A/\pi)^{1/2}$), peripheral lengths (L), maximum lengths (ML), envelope peripheral lengths (C) and a particle projection image area (A), from which the values of circularity, unevenness-1 and unevenness-2 of the individual particles are calculated and averaged.

The above-values are measured with respect to toner particles having $D_{CE}\geqq 2$ μm, and at least 3000 particles, preferably at least 5000 particles, should be measured in order to obtain reliable results.

As a specific measurement apparatus, a multi-image analyzer (available from Beckman Coulter Co.) was used.

The multi-image analyzer is an apparatus based on particle size distribution analyzer according to the electrical resistance method (Coulter method) in combination with a CCD camera for photographing particle images and a particle image analyzer. More specifically, sample particles are dispersed in an electrolytic solution and caused to pass through an aperture of a Coulter Multisizer (as a particle size distribution meter according to the electrical resistance method), thereby determining a particle size based on an electrical resistance change caused by the particle passing through the aperture, and simultaneously photographing the particle image through a CCD camera by a synchronous strobe action, for image analysis after digitalizing the photographed particle image.

The particle size distribution referred to herein is based on values measured according to the Coulter counter method, e.g., by using "Coulter Counter TA-II or Multisizer" (=trade name, available from Coulter Electronics Inc.).

In the measurement, a 1%-NaCl aqueous solution may be prepared by using a reagent-grade sodium chloride as an electrolytic solution. It is also possible to use ISOTON R-II (available from Coulter Scientific Japan K.K.). Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of at least 2 μm by using the above-mentioned apparatus with a 100 μm-aperture to obtain a volume-basis distribution and a number-basis distribution. From the volume-base distribution and number-basis distribution, a weight-average particle size (D4) and a number-average particle size (D1), respectively, are calculated.

In pulverizing the crushed powdery feed by the above-mentioned mechanical pulverizer, it is preferred to introduce cold air at a temperature of 0° C. to −30° C. from a cold air-generating means 321 together with the powdery feed. It is further preferred that the pulverizer main body is covered with a jacket 316 for flowing cooling water (preferably, non-freezing liquid comprising ethylene glycol, etc.), so as to maintain the temperature within a whirlpool chamber 212 at 0° C. or below, more preferably −5 to −15° C., further preferably −7 to −12° C., in view of the toner productivity. This is effective for suppressing the surface deterioration of toner particles due to pulverization heat, particularly the liberation of magnetic iron oxide particles present at the toner particle surfaces and melt-sticking of toner particles onto the apparatus wall, thereby allowing effective pulverization of the powdery feed. The operation at a whirlpool chamber temperature T1 above 0° C. is liable to cause toner surface denaturation and melt-sticking onto the inner wall, thus being undesirable from toner productivity.

The cold air-generating means 321 should preferably use substitute flon the viewpoint of global ecology. Examples of the substitute flon may include: R134a, R404A, R407c, R410A, R507A and R717, and R404A is particularly preferred in view of energy economization and safety.

The cooling water is introduced into the jacket 316 via a supply port 317 and discharged out of a discharge port 318.

The pulverizate produced within the mechanical pulverizer is discharged out of the pulverizer via a rear chamber 320 and a powder discharge port 302. In this instance, the temperature T2 in the rear chamber 320 may preferably be 30 to 60° C. in view of toner productivity, more specifically effective pulverization without causing toner surface denaturation. If T2 is below 30° C., a short pass without causing pulverization is possibly caused. Above 60° C., there is a liability of over-pulverization leading to toner surface denaturation and melt-sticking onto the apparatus inner wall.

In the pulverization operation, it is preferred to set the temperature T1 in the whirlpool chamber 212 (inlet temperature) and the temperature T2 in the rear chamber (outlet temperature) so as to provide a temperature difference ΔT (=T2−T1) of 30–80° C., more preferably 35–75° C., further preferably 37–72° C., thereby suppressing the surface deterioration of toner particle surfaces, and effectively pulverizing the powdery feed. A temperature difference ΔT of below 30° C. suggests a possibility of short pass of the powdery feed without effective pulverization thereof, thus being undesirable in view of the toner performances. On the other hand, ΔT >80° C. suggests a possibility of the over-pulverization, resulting in surface deterioration due to heat of the toner particles and melt-sticking of toner particles onto the apparatus wall and thus adversely affecting the toner productivity.

It is preferred that the inlet temperature (T1) in the mechanical pulverizer is set to at most 0° C. and a value which is lower than the glass transition temperature (Tg) of the binder resin by 60–75° C., wherein Tg is preferably 45 to 75° C., more preferably 55 to 65° C. As a result, it is possible to suppress the surface deterioration of toner particles due to heat, and allow effective pulverization of the powdery feed. Further, the outlet temperature (T2) may preferably be set to a value which is lower by 5–30° C., more preferably 10–20° C., than Tg. As a result, it becomes possible to suppress the surface deterioration of toner particles due to heat, and allow effective pulverization of the powdery feed.

Herein, the glass-transition temperature (Tg) values of the binder resin described herein are based on values measured by using a differential scanning calorimeter ("DSC-7", made by Perkin-Elmer Corp.) under the following conditions.

A sample in an amount of 5–20 mg, preferably 10 mg, is subjected to a thermal history-removal treatment including a cycle of heating from 20°C. to 180° C. at a rate of 10° C./min and cooling from 180° C. at a rate of 10° C./min, and then subjected to a measurement of Tg by heating from 10° C. to 180° C. at a rate of 10° C./min. For the Tg-measurement, the sample is placed in an aluminum pan while using a blank aluminum pan as a reference. During the heating, a heat-absorption peak occurs between a first base line and a second base line, and Tg is determined as a temperature of an intersection of a line drawn between the first and second base lines with a rising curve on the heat-absorption peak.

The rotor 314 may preferably be rotated so as to provide a circumferential speed of 80–180 m/s, more preferably 90–170 m/s, further preferably 100–160 m/s. As a result, it becomes possible to suppress insufficient pulverization or overpulverization, and allow effective pulverization of the powdery feed. A circumferential speed below 80 m/s of the rotor 314 is liable to cause a short pass without pulverization of the feed, thus resulting in inferior toner performances. A circumferential speed exceeding 180 m/s of the rotor invites an overload of the apparatus and is liable to cause overpulverization resulting in surface deterioration of toner particles due to heat, and also melt-sticking of the toner particles onto the apparatus wall, thus adversely affecting the toner productivity.

Further, the rotor 314 and the stator 310 may preferably be disposed to provide a minimum gap therebetween of 0.5–10.0 mm, more preferably 1.0–5.0 mm, further preferably 1.0–3.0 mm. As a result, it becomes possible to suppress insufficient pulverization or overpulverization and allow effective pulverization of the powdery feed. A gap exceeding 10.0 mm between the rotor 314 and the stator 310 is liable to cause a short pass without pulverization of the powdery feed, thus adversely affecting the toner performance. A gap smaller than 0.5 mm invites an overload of the apparatus and is liable to cause overpulverization resulting in surface deterioration of toner particles due to heat, and also melt-sticking of the toner particles onto the apparatus wall, thus adversely affecting the toner productivity.

EXAMPLES

Hereinbelow, the present invention will be described more specifically based on Examples.

Example 1

| | |
|---|---|
| Binder resin (polyester resin) (Tg = 59° C., acid value = 20 mgKOH/g, hydroxyl value = 30 mgKOH/g, molecular weights: Mp = 6800, Mn = 2900, Mw = 53000) | 100 wt. parts |
| Magnetic iron oxide (Dav. = 0.20 μm, Hc = 9.1 kA/m, σs = 82.1 $Am^2/kg$, σr = 11.4 $Am^2/kg$, after magnetization at a field of 795.8 kA/m) | 90 wt. parts |
| Monoazo metal complex (negative charge control agent) | 2 wt. parts |
| Low-molecular weight ethylene-propylene copolymer | 3 wt. parts |

The above ingredients were well-blended by a Henschel mixer and kneaded by a twin-screw extruder heated at 130° C. After being cooled, the kneaded product was coarsely crushed to below 1 mm by a hammer mill to provide a powdery feed (crushed product).

The powdery feed was pulverized by a mechanical pulverizer 301 having an organization as shown in FIG. 1 ("Turbomill T250–RS", made by Turbo Kogyo K.K.) after remodeling in a manner described below and then classified by a multi-division pnuematic classifier 1 as shown in FIG. 9.

More specifically, in this Example, the pulverization surfaces (outer well and inner well) of the rotor 314 and the stator 310 were set to have surface shapes as shown in FIG. 3 including wave-shaped projection 321 and intervening recesses having a flat-faced bottom 322 and a trapezoidal section 323 on the stator surface. The stator 310 exhibited angles β1=45 deg., β2=10 deg., a height H=2.0 mm and a flat-faced bottom length L1=1.4 mm (with reference to FIG. 5). The rotor 314 was rotated at a peripheral speed of 115 m/s with a gap of 1.5 mm from the inner wall of the stator 310. The powdery feed supply rate was adjusted so as to obtain toner particles having a weight-average particle size (D4) of 7.4 μm.

As a result, toner particles of D4=7.4 μm were obtained at a feed supply rate of 19.3 kg/hr which amounted to an effective pulverization ratio (Rp) of 1.3 as defined as a ratio of the feed supply rate to a feed supply rate in a corresponding Reference Example giving an identical toner particle size described hereinafter.

During the pulverization, the cooling air temperature was −15° C., the whirling chamber temperature T1 was −10° C. and the rear chamber temperature T2 was 40° C. giving ΔT (=T2−T1)=50° C., Tg−T1=69° C. and Tg−T2=19° C.

Then, the pulverizate from the mechanical pulverizer 301 was introduced into a classifier 1 having an organization shown in FIG. 9 to obtain toner particles of D4=7.3 μm containing 89.4% by volume (V %) of particles of 3.17 to 10.1 μm.

As a result of measurement by "Multi-Image Analyzer" (made by Beckman Coulter Co.), the toner particles exhibited an average circularity (Cav) of 0.748, an unevenness-1 of 1.144 and an unevenness-2 of 1.067, thus realizing a good combination of toner productivity and toner shape.

100 wt. parts of the toner particles were blended with 1.0 wt. part of dry-process silica having a primary particle size of 12 nm and hydrophobized with hexamethyldisilazane and silicone oil by a Henschel mixer to obtain Toner 1.

Then, Toner 1 was incorporated in a commercially available copying machine ("NP6530", made by Canon K.K.) after remodeling for changing the process speed from 320 mm/sec to 400 mm/sec and subjected evaluation with respect to the following items.

1. Toner Application State 330 g of Toner 1 was charged in a developer vessel of the apparatus and left to stand overnight (for at least 12 hours) in an environment of low temperature/low humidity (15° C./10% RH). Thereafter, the toner-carrying member was rotated by an external drive mechanism to observe a toner application state on the toner-carrying member at a point of 10 min. after starting the rotation. The toner application state was observed with eyes and evaluated according to the following standard:

A: Very uniform application state.

B: The toner application state is generally uniform but is accompanied with a ripple pattern at a very limited part.

C: The toner application state is partially accompanied with a ripple pattern.

D: The toner application state on the toner-carrying member is wholly accompanied with a ripple pattern.

E: The ripple pattern has been grown to provide clearly recognizable unevennesses at some parts.

F: The unevennesses of toner application layer are clearly recognizable over the entirety of the toner carrying member.

2. Fog 330 g of Toner 1 was charged in a developer vessel of the apparatus, and after standing overnight (for at least 12 hours) in a low temperature/low humidity environment (15° C./10% RH), was subjected to image formation for reproduction of a density evaluation chart on 200 sheets. After the image formation, a solid white image was formed on a white paper to measure a reflectance by a reflection meter ("REFLECTMETER", made by Tokyo Denshoku K.K.) to measure a fog density according to the following formula:

Fog (%)=(reflectance of blank white paper)−(reflectance of the reproduced solid image).

Based on the measured value, the evaluation was performed according to the following standard.

A: <0.1%

B: ≧0.1% and <0.5%

C: ≧0.5% and <1.0%

D: ≧1.0% and <1.5%

E: ≧1.5% and <2.0%

F: ≧2.0%

The above-mentioned pulverization conditions and evaluation results are summarized in Tables 1 and 2, respectively, together with those of the following Examples.

Example 2

The toner production by using a mechanical pulverizer and the evaluation of the resultant toner (Toner 2) were performed in the same manner as in Example 1 except for changing the pulverization surface shapes of the rotor and the stator as shown in FIG. 4 including a wave-shaped surface pattern 325 on the stator surface, and wave-shaped projections 328 and intervening recesses having a flat-faced bottom 327 and a trapezoidal section 326 on the rotor surface. The rotor exhibited angles α1=45 deg., α2=10 deg., a height H=2.0 mm, a flat-faced bottom length L1=1.4 mm. The rotor 314 was rotated at a peripheral speed of 115 m/s with a gap of 1.5 mm from the inner wall of the stator 310. The powdery feed supply rate was adjusted so as to obtain toner particles of D4=7.4 μm.

As a result, pulverizate toner particles of D4=7.4 μm were obtained at a feed supply rate of 20.7 kg/hr giving Rp=1.4.

During the pulverization, the cooling air temperature was −15° C., the whirling chamber temperature T1 was −10° C., and the rear chamber temperature T2 was 41° C. giving ΔT (=T2−T1)=51° C., Tg−T1=69° C., and Tg−T2=18° C. The classified toner particles exhibited D4=7.2 μm and contained 88.2% by volume of particles of 3.17–10.1 μm.

The toner particles also exhibited Cav=0.748, an unevenness-1=1.097 and an unevenness-2=1.063.

Example 3

The toner production by using a mechanical pulverizer and the evaluation of the resultant toner (Toner 3) were performed in the same manner as in Example 1 except for changing the pulverization surface shapes of the rotor and the stator as shown in FIG. 5 including wave-shaped projections 329, and intervening recesses having a flat-faced bottom 330 and a trapezoidal section 331 and defined between a first (forward) slope 339 and a second (rear) slope 340 on the stator surface; and wave-shaped projections 334, and intervening recesses having a flat-faced bottom 333 and a trapezoidal section 332 and defined between a first (rear) slope 332 and a second (forward) slope 338 on the rotor surface. The rotor and stator exhibited angles α1=45 deg., β1=45 deg., α2=10 deg., β2=10 deg., heights H=2.0 mm, flat-faced bottom lengths L1=1.4 mm. The rotor 314 was rotated at a peripheral speed of 115 m/s with a gap of 1.5 mm from the inner wall of the stator 310. The powdery feed supply rate was adjusted so as to obtain toner particles of D4=7.4 μm.

As a result, pulverizate toner particles of D4=7.4 μm were obtained at a feed supply rate of 21.0 kg/hr giving Rp=1.4.

During the pulverization, the cooling air temperature was −15° C., the whirling chamber temperature T1 was −10° C., and the rear chamber temperature T2 was 43° C. giving ΔT (=T2−T1)=53° C., Tg−T1=69° C., and Tg−T2=16° C. The classified toner particles exhibited D4=7.4 μm and contained 89.0% by volume of particles of 3.17–10.1 μm.

The toner particles also exhibited Cav=0.742, an unevenness-1=1.083 and an unevenness-2=1.045.

Examples 4–6

Toners 4–6 were prepared in the same manner as in Examples 1–3 (using the pulverization surface of the rotor and stator shown in FIGS. 3, 4 and 5), respectively, except for changing the powdery feed supply rates to the mechanical pulverizer so as to provide pulverizate toner particles of D4=7.8 μm.

Examples 7–9

Toners 7–9 were prepared in the same manner as in Examples 1–3 (using the pulverization surface of the rotor and stator shown in FIGS. 3, 4 and 5), respectively, except for changing the powdery feed supply rates to the mechanical pulverizer so as to provide pulverizate toner particles of D4=7.0 μm.

TABLE 1

Examples - Pulverization conditions

| Example | 1 | 2 | 3 | 4 | 5 | 6 | 7 | 8 | 9 |
|---|---|---|---|---|---|---|---|---|---|
| Pulverizer | FIG. 1 | FIG. 1 | FIG. 1 | FIG. 1 | FIG. 1 | FIG. 1 | FIG. 1 | FIG. 1 | FIG. 1 |
| Rotor/Stator surface | FIG. 3 | FIG. 4 | FIG. 5 | FIG. 3 | FIG. 4 | FIG. 5 | FIG. 3 | FIG. 4 | FIG. 5 |
| Projection height H (mm) | 2.0 | 2.0 | 2.0 | 2.0 | 2.0 | 2.0 | 2.0 | 2.0 | 2.0 |
| Recess bottom flat length L1 (mm) | 1.4 | 1.4 | 1.4 | 1.4 | 1.4 | 1.4 | 1.4 | 1.4 | 1.4 |
| Rotor angle α1 (deg) | — | 45 | 45 | — | 45 | 45 | — | 45 | 45 |
| Rotor angle α2 (deg) | — | 10 | 10 | — | 10 | 10 | — | 10 | 10 |
| Stator angle β1 (deg) | 45 | — | 45 | 45 | — | 45 | 45 | — | 45 |
| Stator angle β2 (deg) | 10 | — | 10 | 10 | — | 10 | 10 | — | 10 |
| Resin Tg (° C.) | 59 | 59 | 59 | 59 | 59 | 59 | 59 | 59 | 59 |
| Cooling air temp. ° C. | −15 | −15 | −15 | −15 | −15 | −15 | −15 | −15 | −15 |
| Jacket cooling | yes | yes | yes | yes | yes | yes | yes | yes | yes |
| T1 (° C.) | −10 | −10 | −10 | −10 | −10 | −10 | −10 | −10 | −10 |
| T2 (° C.) | 40 | 41 | 43 | 54 | 54 | 56 | 30 | 31 | 32 |
| ΔT (° C.) | 50 | 51 | 53 | 64 | 64 | 66 | 40 | 41 | 42 |
| Tg-T1 (° C.) | 69 | 69 | 69 | 69 | 69 | 69 | 69 | 69 | 69 |
| Tg-T2 (° C.) | 19 | 18 | 16 | 5 | 5 | 3 | 29 | 28 | 27 |
| Rotor speed (m/s) | 115 | 115 | 115 | 115 | 115 | 115 | 115 | 115 | 115 |
| Rotor/Stator gap (mm) | 1.5 | 1.5 | 1.5 | 1.5 | 1.5 | 1.5 | 1.5 | 1.5 | 1.5 |

TABLE 2

Examples - Performances

| Example | 1 | 2 | 3 | 4 | 5 | 6 | 7 | 8 | 9 |
|---|---|---|---|---|---|---|---|---|---|
| Objective pulverizate D4 (μm) | 7.4 | 7.4 | 7.4 | 7.8 | 7.8 | 7.8 | 7.0 | 7.0 | 7.0 |
| Supply rate (kg/hr) | 19.3 | 20.7 | 21.0 | 23.7 | 25.5 | 25.8 | 17.6 | 18.9 | 19.2 |
| Pulverization ratio | 1.3 | 1.4 | 1.4 | 1.2 | 1.3 | 1.3 | 1.3 | 1.4 | 1.4 |
| Classifier | FIG. 9 | FIG. 9 | FIG. 9 | FIG. 9 | FIG. 9 | FIG. 9 | FIG. 9 | FIG. 9 | FIG. 9 |
| Classified D4 (μm) | 7.3 | 7.2 | 7.4 | 7.7 | 7.6 | 7.8 | 6.9 | 6.8 | 7.0 |
| V % of ≧3.17 μm and ≦10.1 μm | 89.4 | 88.2 | 89.0 | 84.9 | 83.8 | 86.0 | 94.4 | 93.0 | 90.7 |
| Circularity (Cav) | 0.748 | 0.750 | 0.742 | 0.746 | 0.749 | 0.752 | 0.754 | 0.748 | 0.752 |
| Unevennes-1 | 1.144 | 1.097 | 1.083 | 1.089 | 1.129 | 1.107 | 1.113 | 1.112 | 1.080 |

TABLE 2-continued

| Examples - Performances | | | | | | | | | |
|---|---|---|---|---|---|---|---|---|---|
| Example | 1 | 2 | 3 | 4 | 5 | 6 | 7 | 8 | 9 |
| Unevennes-2 | 1.067 | 1.063 | 1.045 | 1.055 | 1.043 | 1.042 | 1.045 | 1.041 | 1.065 |
| Toner appln. state | B | B | A | B | B | A | B | B | A |
| Fog | B | A | A | B | A | A | B | A | A |

Reference Example 1

The toner production by using a mechanical pulverizer and the evaluation of the resultant toner (Reference Toner 1) were performed in the same manner as in Example 1 except for changing the pulverization surface shapes of the rotor and the stator to those represented by numerals 336 and 335, respectively, as shown in FIG. 6.

The crushed feed supply rate was adjusted so as to provide pulverizate toner particles of D4=7.4 μm similarly as in Example 1 and under identical conditions with respect to the rotor peripheral speed and the gap between the rotor and stator as in Example 1.

During the pulverization, the cooling air temperature was −15° C., the whirling chamber temperature T1 was −10° C., and the rear chamber temperature T2 was 40° C. giving ΔT (=T2−T1)=50° C., Tg−T1=69° C. and Tg−T2=19° C.

As a result, pulverizate toner particles of D4=7.4 μm were prepared at a feed supply rate of 15 kg/hr, thus showing a somewhat lower pulverization efficiency (Rp=1.0) than Example 1.

The classified toner particles exhibited Cav=0.742, Unevenness-1=1.089, and Unevenness-2=1.043.

Thus, a combination of the toner production efficiency and the toner shape was generally acceptable but was somewhat inferior than Example 1.

The pulverization conditions and evaluation results are inclusively shown in Tables 3 and 4 together with those of the following Reference Examples.

Reference Example 2

The toner production by using a mechanical pulverizer and the evaluation of the resultant toner (Reference Toner 2) were performed in the same manner as in Example 1 except for changing the pulverization surface shapes of the rotor and the stator to those represented by numerals 336 and 335, respectively, as shown in FIG. 6.

The crushed feed supply rate was adjusted so as to provide pulverizate toner particles of D4=7.8 μm similarly as in Example 4 and under identical conditions with respect to the rotor peripheral speed and the gap between the rotor and stator as in Example 1.

During the pulverization, the cooling air temperature was −15° C., the whirling chamber temperature T1 was −10° C., and the rear chamber temperature T2 was 43° C. giving T (=T2−T1)=53° C., Tg−T1=69° C. and Tg−T2=16° C.

As a result, pulverizate toner particles of D4=7.8 μm were prepared at a feed supply rate of 20 kg/hr, thus showing a somewhat lower pulverization efficiency (Rp=1.0) than Example 4.

The classified toner particles exhibited Cav=0.750, Unevenness-1 =1.134, and Unevenness-2=1.045.

Thus, a combination of the toner production efficiency and the toner shape was generally acceptable but was somewhat inferior than Example 4.

Reference Example 3

The toner production by using a mechanical pulverizer and the evaluation of the resultant toner (Reference Toner 3) were performed in the same manner as in Example 1 except for changing the pulverization surface shapes of the rotor and the stator to those represented by numerals 336 and 335, respectively, as shown in FIG. 6.

The crushed feed supply rate was adjusted so as to provide pulverizate toner particles of D4=7.0 μm similarly as in Example 7 and under identical conditions with respect to the rotor peripheral speed and the gap between the rotor and stator as in Example 1.

During the pulverization, the cooling air temperature was −15° C., the whirling chamber temperature T1 was −10° C., and the rear chamber temperature T2 was 41° C. giving ΔT (=T2−T1)=51° C., Tg−T1=69° C. and Tg−T2=18° C.

As a result, pulverizate toner particles of D4=7.0 μm were prepared at a feed supply rate of 13.5 kg/hr, thus showing a somewhat lower pulverization efficiency (Rp=1.0) than Example 7.

The classified toner particles exhibited Cav=0.745, Unevenness-1=1.088, and Unevenness-2=1.065.

Thus, a combination of the toner production efficiency and the toner shape was gradually acceptable but was somewhat inferior than Example 7.

TABLE 3

| Reference Examples - Pulverization conditions | | | |
|---|---|---|---|
| | Example | | |
| | Ref. 1 | Ref. 2 | Ref. 3 |
| Pulverizer | FIG. 1 | FIG. 1 | FIG. 1 |
| Rotor/Stator surface | FIG. 6 | FIG. 6 | FIG. 6 |
| Resin Tg (° C.) | 59 | 59 | 59 |
| Cooling air temp. ° C. | −15 | −15 | −15 |
| Jacket cooling | yes | yes | yes |
| T1 (° C.) | −10 | −10 | −10 |
| T2 (° C.) | 40 | 43 | 41 |
| ΔT (° C.) | 50 | 53 | 51 |
| Tg-T1 (° C.) | 69 | 69 | 69 |
| Tg-T2 (° C.) | 19 | 16 | 18 |
| Rotor speed (m/s) | 115 | 115 | 115 |
| Rotor/Stator gap (mm) | 1.5 | 1.5 | 1.5 |

TABLE 4

Reference Examples - Performances

| | Example | | |
|---|---|---|---|
| | Ref. 1 | Ref. 2 | Ref. 3 |
| Objective pulverizate D4 (μm) | 7.4 | 7.8 | 7.0 |
| Supply rate (kg/hr) | 15.0 | 20.0 | 13.5 |
| Pulverization ratio | 1.0 | 1.0 | 1.0 |
| Classifier | FIG. 9 | FIG. 9 | FIG. 9 |
| Classified D4 (μm) | 7.3 | 7.6 | 7.0 |
| V % of ≧ 3.17 μm and ≦ 10.1 μm | 87.9 | 85.1 | 93.6 |
| Circularity (Cav) | 0.742 | 0.750 | 0.745 |
| Unevennes-1 | 1.089 | 1.134 | 1.088 |
| Unevennes-2 | 1.043 | 1.045 | 1.065 |
| Toner appln. state | A | C | B |
| Fog | A | B | C |

Comparative Example 1

The toner production by using a mechanical pulverizer and the evaluation of the resultant toner (Comparative Toner 1) were performed in the same manner as in Example 1 except for changing the pulverization surface shapes of the rotor and the stator to those represented by numerals 341 and 342, respectively, as shown in FIG. 7.

The crushed feed supply rate was adjusted so as to provide pulverizate toner particles of D4=7.4 μm similarly as in Example 1 and under identical conditions with respect to the rotor peripheral speed and the gap between the rotor and stator as in Example 1.

During the pulverization, the cooling air temperature was −15° C., the whirling chamber temperature T1 was −10° C., and the rear chamber temperature T2 was 40° C. giving ΔT (=T2−T1) 50° C., Tg−T1=69° C. and Tg−T2=19° C.

As a result, pulverizate toner particles of D4=7.4 μm were prepared at a feed supply rate of 13.5 kg/hr, thus showing a lower pulverization efficiency (Rp=0.9) than Example 1.

The classified toner particles exhibited Cav=0.733, Unevenness-1=1.127, and Unevenness-2=1.040.

Thus, in order to obtain toner particles having particle sizes and shapes comparable to those obtained in Example 1, the pulverization efficiency had to be substantially lowered.

As a result of the toner application and image formation tests performed in the same manner as in Example 1, Comparative Toner 1 also exhibited inferior performances.

The pulverization conditions and evaluation results are inclusively shown in Tables 5 and 6 together with those of the following Comparative Examples.

Comparative Example 2

The toner production by using a mechanical pulverizer and the evaluation of the resultant toner (Reference Toner 1) were performed in the same manner as in Example 1 except for changing the pulverization surface shapes of the rotor and the stator to those as shown in FIG. 8, including rectangular projections and recesses as represented by 343–346 both on the rotor and the stator.

The crushed feed supply rate was adjusted so as to provide pulverizate toner particles of D4=7.4 μm similarly as in Example 1 and under identical conditions with respect to the rotor peripheral speed and the gap between the rotor and stator as in Example 1.

During the pulverization, the cooling air temperature was −15° C., the whirling chamber temperature T1 was −10° C., and the rear chamber temperature T2 was 41° C. giving T (=T2−T1)=51° C., Tg−T1=69° C. and Tg−T2=18° C.

As a result, pulverizate toner particles of D4=7.4 μm were prepared at a feed supply rate of 12.5 kg/hr, thus showing a lower pulverization efficiency (Rp=0.8) than Example 1.

The classified toner particles exhibited Cav=0.733, Unevenness-1=1.127, and Unevenness-2=1.040.

Thus, in order to obtain toner particles having particle sizes and shapes comparable to those obtained in Example 1, the pulverization efficiency had to be substantially lowered.

As a result of the toner application and image formation tests performed in the same manner as in Example 1, Comparative Toner 2 also exhibited inferior performances.

Comparative Example 3

Figure 11:
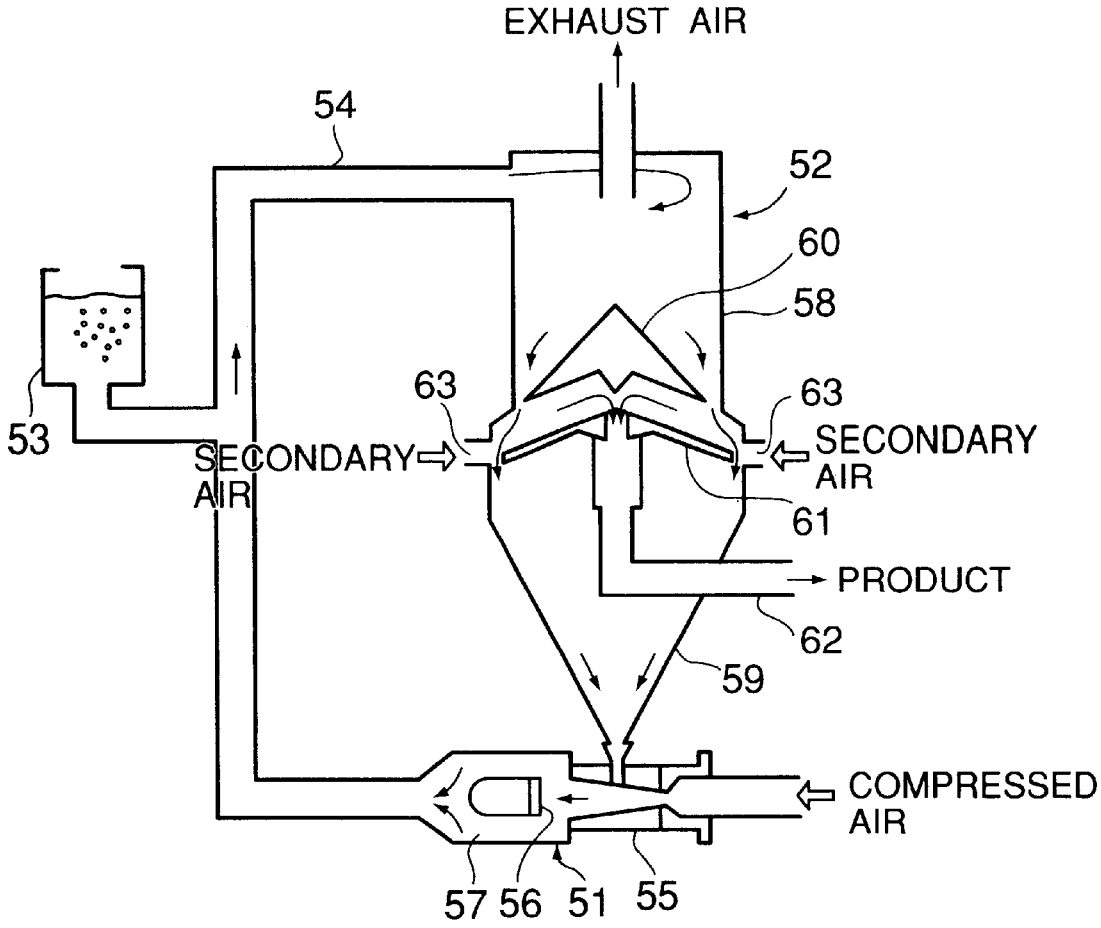
FIG. 11 is a schematic sectional view of a pulverization system including an impingement-type pneumatic pulverizer used in a Comparative Example.

The crushed powdery feed prepared in Example 1 was pulverized by means of an impingement-type pneumatic pulverizer system ("IDS-2", made by Nippon Pneumatic Kogyo K.K.) having an organization as shown in FIG. 11 and including a pulverizer 51, a classifier 52, a feed supply section 53, a conveyer pipe 54, a nozzle 55, an impinging plate 56, a pulverization chamber 57, a collector 58, a hopper 59, an upper center core 60, a lower center core 61, an exhaust pipe 62 and a secondary air supply port 63.

The impingement-type pneumatic pulverizer was operated at a compressed air pressure of 6.0 kg/cm$^2$G, and the feed supply rate was set to 15 kg/hr so as to obtain pulverized toner particles of D4=7.4 μm similarly as in Example 1.

The pulverizate toner particles were classified by a pneumatic classifier having an organization as shown in FIG. 9 to obtain classified toner particles which exhibited Cav=0.714, unevenness-1=1.175 and Unevenness-2=1.094.

By blending the classified toner particles with hydrophobized silica similarly as in Example 1 to obtain Comparative Toner 3, which was also evaluated in the same manner as in Example 1. As a result, Comparative Toner 3 exhibited clearly inferior results with respect to toner application state and fog.

TABLE 5

Comparative Examples - Pulverization conditions

| | Example | | |
|---|---|---|---|
| | Comp. 1 | Comp. 2 | Comp. 3 |
| Pulverizer | FIG. 1 | FIG. 1 | FIG. 11 |
| Rotor/Stator surface | FIG. 7 | FIG. 8 | — |
| Resin Tg (° C.) | 59 | 59 | 59 |
| Cooling air temp. ° C. | −15 | −15 | — |
| Jacket cooling | yes | yes | — |
| T1 (° C.) | −10 | −10 | — |
| T2 (° C.) | 40 | 41 | — |
| ΔT (° C.) | 50 | 51 | — |

TABLE 5-continued

Comparative Examples - Pulverization conditions

| | Example | | |
|---|---|---|---|
| | Comp. 1 | Comp. 2 | Comp. 3 |
| Tg-T1 (° C.) | 69 | 69 | — |
| Tg-T2 (° C.) | 19 | 18 | — |
| Rotor speed (m/s) | 115 | 115 | — |
| Rotor/Stator gap (mm) | 1.5 | 1.5 | — |
| Compressed air press. ($kg/cm^2$) | — | — | 6.0 |

TABLE 6

Comparative Examples - Performances

| | Example | | |
|---|---|---|---|
| | Comp. 1 | Comp. 2 | Comp. 3 |
| Objective pulverizate D4 (μm) | 7.4 | 7.4 | 7.4 |
| Supply rate (kg/hr) | 13.5 | 12.5 | 15.0 |
| Pulverization ratio | 0.9 | 0.8 | — |
| Classifier | FIG. 9 | FIG. 9 | FIG. 9 |
| Classified D4 (μm) | 7.3 | 7.6 | 7.4 |
| V % of ≧3.17 μm and ≦10.1 μm | 87.6 | 84.5 | 83.5 |
| Circularity (Cav) | 0.740 | 0.733 | 0.714 |
| Unevennes-1 | 1.106 | 1.127 | 1.175 |
| Unevennes-2 | 1.077 | 1.040 | 1.094 |
| Toner appln. state | C | C | D |
| Fog | C | C | D |

What is claimed is:

1. A process for producing a toner, comprising:

melt-kneading a mixture comprising at least a binder resin and a colorant to form a kneaded product, cooling the kneaded product, coarsely crushing the cooled kneaded product to provide a crushed product, and pulverizing the crushed product by means of a mechanical pulverizer to provide a toner having a weight-average particle size of 3 to 12 μm, wherein the mechanical pulverizer includes an inlet port for introducing the crushed product into a pulverization zone to form a pulverizate, a cooling means for cooling the pulverization zone, a discharge port for discharging the pulverizate out of the pulverization zone, a rotor rotatably supported about a rotation axis and having an outer wall, a stator surrounding the rotor and having an inner wall spaced apart from the outer wall of the rotor so as to form the pulverization zone between the inner wall of the stator and the outer wall of the rotor where the crushed product is pulverized into the pulverizate, each of the outer wall of the rotor and the inner wall of the stator is provided with a plurality of grooves which extend generally in parallel with the rotation axis of the rotor and are formed of a wave-shaped plurality of projections and intervening recesses, so that the recesses of at least one of the outer wall of the rotor and the inner wall of the stator have flat-faced bottoms, and in case where the outer wall of the rotor has the recesses having flat-faced bottoms, each recess of the outer wall has a corner (A) at a rear edge of the flat-faced bottom with respect to the rotation direction of the rotor and adjacent to a rising slope which forms an angle (α1) of at least 10 deg. and below 80 deg. in a direction opposite to the rotation direction with respect to a reference line connecting the rotation axis and the corner (A), and in case where the inner wall of the stator has the recesses having flat-faced bottoms, each recess of the inner wall has a corner (A') at a forward edge of the flat-faced bottom with respect to the rotation direction of the rotor and adjacent to a rising slope which forms an angle (β1) of at least 10 deg. and below 80 deg. in the rotation direction with respect to a reference line connecting the rotation axis of the rotor and the corner (A').

2. The process according to claim 1, wherein the pulverized toner is provided with a particle size distribution containing at least 80% by volume of toner particles in a particle size range of 3.17 μm to 10.1 μm and containing toner particles of circle-equivalent diameter of at least 2 μm showing an average circularity of 0.73 to 0.90, an average unevenness-1 of 1.07 to 1.15 and an average unevenness-2 of 1.03 to 1.08.

3. The process according to claim 1, wherein each recess having a flat-faced bottom on the rotor has a forward slope forming an angle (α2) of below 20 deg. in the rotation direction, with respect to a reference line connecting the rotation axis and a top (C) of the forward slope.

4. The process according to claim 1, wherein each recess having a flat-faced bottom on the stator has a rear slope forming an angle (β2) of below 20 deg. in a direction opposite to the rotation direction, with respect to a reference line connecting the rotation axis and a top (C') of the rear slope.

5. The process according to claim 1, wherein each recess having a flat-faced bottom on the rotor has a forward slope forming an angle (α2) of below 20 deg. in the rotation direction, with respect to a reference line connecting the rotation axis and a top (C) of the forward slope; and each recess having a flat-faced bottom on the stator has a rear slope forming an angle (β2) of below 20 deg. in a direction opposite to the rotation direction, with respect to a reference line connecting the rotation axis and a top (C') of the rear slope.

6. The process according to claim 1, wherein the recesses on the stator have a curved-faced bottom, and the recesses on the rotor have a flat-faced bottom.

7. The process according to claim 1, wherein the recesses on the rotor have a curved-faced bottom, and the recesses on the stator have a flat-faced bottom.

8. The process according to claim 1, wherein each projection has a height H of 1.00–3.00 mm and each recess has a flat-faced bottom length L1 of 0.60–2.00 mm on the stator in a section perpendicular to the rotation axis.

9. The process according to claim 8, wherein the height H and the flat-faced bottom length L1 satisfy a relationship of $$0.25H \leqq L1 \leqq 2.5H.$$

10. The process according to claim 1, wherein each projection has a height H of 1.00–3.00 mm and each recess has a flat-faced bottom length L1 of 0.60–2.00 mm on the rotor in a section perpendicular to the rotation axis.

11. The process according to claim 1, wherein the rotor and/or the stator have a projection having a top width L2 and a root width L3 satisfying a relationship of L2<L3.

12. The process according to claim 1, wherein the toner is a magnetic toner containing a magnetic material in an amount of 60–200 wt. parts per 100 wt. parts of the binder resin.

13. The process according to claim 1, wherein the crushed product is introduced together with cold air into the mechanical pulverizer.

14. The process according to claim 13, wherein the cold air is at a temperature of 0 to −30° C.

15. The process according to claim 1, wherein the mechanical pulverizer is equipped with a cooling jacket for introducing thereinto a cooling liquid to cool the pulverization zone while the crushed product is pulverized.

16. The process according to claim 1, wherein the mechanical pulverizer includes a whirling chamber communicative with the inlet port and maintained at a temperature of at most 0° C.

17. The process according to claim 16, wherein the whirling chamber is maintained at a temperature of −5 to −15° C.

18. The process according to claim 16, wherein the whirling chamber is maintained at a temperature of −7 to −12° C.

19. The process according to claim 16, wherein the mechanical pulverizer includes a rear chamber between the pulverization chamber and the discharge port, wherein the rear chamber is maintained at a temperature T2 and the whirling chamber is maintained at a temperature T1 to provide a temperature difference ΔT (=T2−T1) of 30–80° C.

20. The process according to claim 19, wherein ΔT (=T2−T1) is 35–75° C.

21. The process according to claim 19, wherein ΔT (=T2−T1) is 37–72° C.

22. The process according to claim 16, wherein the binder resin has a glass-transition temperature Tg of 45–75° C., and the whirling chamber temperature T1 is controlled to be lower than Tg by 60–75° C.

23. The process according to claim 16, wherein the binder resin has a glass-transition temperature Tg of 45–75° C., and the rear chamber temperature T2 is controlled to be lower than Tg by 5–30° C.

24. The process according to claim 1, wherein the mechanical pulverizer includes a rear chamber between the pulverization chamber and the discharge port, and the rear chamber is maintained at a temperature T2 of 30–60° C. before discharging the pulverizate out of the discharged port.

25. The process according to claim 1, wherein the rotor is rotated at a tip peripheral speed of 80 to 180 m/sec, and the stator is disposed with a minimum gap of 0.5 to 10.0 mm from the rotor.

26. The process according to claim 1, wherein the toner is produced at a weight-average particle size of 4–12 μm.

* * * * *

UNITED STATES PATENT AND TRADEMARK OFFICE

CERTIFICATE OF CORRECTION

PATENT NO. : 6,630,277 B2
DATED : October 7, 2003
INVENTOR(S) : Takeski Naka et al.

It is certified that error appears in the above-identified patent and that said Letters Patent is hereby corrected as shown below:

Column 5,
Line 32, “methacrylate” should be deleted; and
Line 33, “groups” should read -- methacrylate groups --.

Column 6,
Line 24, “poly-carboxylic” should read -- polycarboxylic --.

Column 30,
Line 17, “discharged” should read -- discharge --.

Signed and Sealed this

Thirtieth Day of March, 2004

JON W. DUDAS
*Acting Director of the United States Patent and Trademark Office*